US010602768B2

(12) United States Patent
Gao et al.

(10) Patent No.: US 10,602,768 B2
(45) **Date of Patent: *Mar. 31, 2020**

(54) ORAL TOBACCO PRODUCT

(71) Applicant: Altria Client Services LLC, Richmond, VA (US)

(72) Inventors: Feng Gao, Midlothian, VA (US); Frank Scott Atchley, Tarpon Springs, FL (US); Gregory James Griscik, Midlothian, VA (US); Christopher Joseph DiNovi, Richmond, VA (US); Phillip M. Hulan, Midlothian, VA (US); Diane L. Gee, Chesterfield, VA (US); Munmaya K. Mishra, Manakin Sabot, VA (US); James Arthur Strickland, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/816,814

(22) Filed: Nov. 17, 2017

(65) Prior Publication Data

US 2018/0070626 A1 Mar. 15, 2018

Related U.S. Application Data

(63) Continuation of application No. 13/745,073, filed on Jan. 18, 2013, now Pat. No. 9,854,830.

(60) Provisional application No. 61/588,851, filed on Jan. 20, 2012.

(51) Int. Cl.
*A24B 13/00* (2006.01)

(52) U.S. Cl.
CPC ..... *A24B 13/00* (2013.01)

(58) Field of Classification Search
None
See application file for complete search history.

(56) References Cited

U.S. PATENT DOCUMENTS

| | | | |
|---|---|---|---|
| 1,977,059 | A | 10/1934 | Hatherell |
| 2,162,738 | A | 6/1939 | McCoy |
| 3,139,436 | A | 6/1964 | Bicking |
| 3,396,735 | A | 8/1968 | Von Bethmann et al. |
| 4,153,063 | A | 5/1979 | Roselius et al. |
| 4,241,090 | A | 12/1980 | Stroz et al. |

(Continued)

FOREIGN PATENT DOCUMENTS

| | | | |
|---|---|---|---|
| CN | 1064594 | A | 9/1992 |
| CN | 1207251 | A | 2/1999 |

(Continued)

OTHER PUBLICATIONS

European Search Report for corresponding Application No. 18174632.2-1105 dated Nov. 7, 2018.

(Continued)

*Primary Examiner* — Eric Yaary
(74) *Attorney, Agent, or Firm* — Harness, Dickey & Pierce, P.L.C.

(57) ABSTRACT

An oral tobacco product includes a body that is wholly receivable in an oral cavity. The body includes a mouth-stable polymer matrix and tobacco fibers embedded in the mouth-stable polymer matrix. The oral tobacco product can be formed by extruding a mixture of mouth-stable polymer and tobacco fibers.

21 Claims, 16 Drawing Sheets

(56) References Cited

U.S. PATENT DOCUMENTS

| | | | | |
|---|---|---|---|---|
| 4,448,208 | A | 5/1984 | Friedrich et al. | |
| 4,516,590 | A | 5/1985 | Teng | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 4,983,405 | A | 1/1991 | Cherukuri et al. | |
| 4,987,907 | A | 1/1991 | Townend | |
| 5,144,967 | A | 9/1992 | Cartwright et al. | |
| 5,372,149 | A | 12/1994 | Roth et al. | |
| 5,417,229 | A | 5/1995 | Summers et al. | |
| 5,487,792 | A | 1/1996 | King et al. | |
| 5,656,284 | A * | 8/1997 | Balkin | A61K 9/006 424/435 |
| 5,906,811 | A | 5/1999 | Hersh | |
| 6,110,495 | A | 8/2000 | Dam | |
| 7,798,151 | B2 | 9/2010 | Krukonis et al. | |
| 9,930,909 | B2 | 4/2018 | Gao et al. | |
| 2004/0101543 | A1 | 5/2004 | Liu et al. | |
| 2004/0118422 | A1 | 6/2004 | Lundin et al. | |
| 2004/0123873 | A1 | 7/2004 | Calandro et al. | |
| 2004/0151771 | A1* | 8/2004 | Gin | A23G 3/362 424/468 |
| 2004/0247669 | A1 | 12/2004 | Gin et al. | |
| 2005/0046363 | A1 | 3/2005 | Yamamoto | |
| 2005/0053665 | A1 | 3/2005 | Ek et al. | |
| 2005/0152971 | A1 | 7/2005 | Rinker et al. | |
| 2005/0178398 | A1 | 8/2005 | Breslin et al. | |
| 2005/0241658 | A1 | 11/2005 | Pera | |
| 2005/0244521 | A1 | 11/2005 | Strickland et al. | |
| 2006/0112965 | A1 | 6/2006 | Whalen | |
| 2006/0185684 | A1* | 8/2006 | Albino | A24B 15/20 131/270 |
| 2006/0191548 | A1 | 8/2006 | Strickland et al. | |
| 2007/0283974 | A1 | 12/2007 | May | |
| 2008/0063609 | A1* | 3/2008 | Nissen | A23G 4/068 424/48 |
| 2008/0124283 | A1 | 5/2008 | Andersen | |
| 2008/0202536 | A1 | 8/2008 | Torrence et al. | |
| 2008/0209586 | A1 | 8/2008 | Nielsen et al. | |
| 2008/0248017 | A1 | 10/2008 | Ron et al. | |
| 2008/0317911 | A1 | 12/2008 | Schleef et al. | |
| 2009/0133703 | A1 | 5/2009 | Strickland et al. | |
| 2009/0214445 | A1 | 8/2009 | Boghani et al. | |
| 2009/0293889 | A1* | 12/2009 | Kumar | A23G 3/48 131/275 |
| 2009/0293895 | A1* | 12/2009 | Axelsson | A24B 15/14 131/352 |
| 2010/0061940 | A1 | 3/2010 | Axelsson et al. | |
| 2010/0068270 | A1 | 3/2010 | Turchetta et al. | |
| 2010/0163062 | A1* | 7/2010 | Atchley | A24B 13/00 131/119 |
| 2010/0170522 | A1 | 7/2010 | Sun et al. | |
| 2010/0247594 | A1 | 9/2010 | Kuzma et al. | |
| 2011/0083688 | A1* | 4/2011 | Mishra | A24B 15/186 131/352 |
| 2011/0139164 | A1 | 6/2011 | Mua et al. | |
| 2011/0139166 | A1 | 6/2011 | Luzenberg, Jr. | |
| 2011/6149904 | | 6/2011 | Fong et al. | |
| 2011/0236442 | A1 | 9/2011 | Miser et al. | |
| 2011/0274628 | A1 | 11/2011 | Borschke | |
| 2011/0287681 | A1 | 11/2011 | DeVall | |
| 2012/0031415 | A1 | 2/2012 | Essen et al. | |
| 2012/0318287 | A1 | 12/2012 | Andersen | |
| 2013/0053603 | A1 | 2/2013 | Norstrom et al. | |
| 2013/0074855 | A1* | 3/2013 | Holton, Jr. | A24B 15/30 131/275 |
| 2013/0186416 | A1 | 7/2013 | Gao et al. | |
| 2013/0186417 | A1 | 7/2013 | Gao et al. | |
| 2013/0186418 | A1 | 7/2013 | Gao et al. | |
| 2013/0186419 | A1 | 7/2013 | Gao et al. | |
| 2013/0189333 | A1 | 7/2013 | Gao et al. | |

FOREIGN PATENT DOCUMENTS

| | | | |
|---|---|---|---|
| CN | 1054884 | C | 7/2000 |
| CN | 1498080 | A | 5/2004 |
| CN | 1622758 | A | 6/2005 |
| CN | 2720557 | Y | 8/2005 |
| CN | 1903057 | A | 1/2007 |
| CN | 1960648 | A | 5/2007 |
| CN | 1961732 | A | 5/2007 |
| CN | 1997350 | A | 7/2007 |
| CN | 201156955 | Y | 12/2008 |
| CN | 101861145 | A | 10/2010 |
| CN | 101877975 | A | 11/2010 |
| CN | 102300478 | A | 12/2011 |
| CN | 102014654 | B | 5/2016 |
| EA | 005421 | | 2/2005 |
| EA | 005626 | | 4/2005 |
| EP | 0118972 | A2 | 9/1984 |
| EP | 0279776 | A2 | 8/1988 |
| EP | 0288909 | A1 | 11/1988 |
| EP | 1578422 | A2 | 9/2005 |
| EP | 2226171 | A1 | 9/2010 |
| EP | 2265263 | A2 | 12/2010 |
| EP | 2804897 | A1 | 11/2014 |
| EP | 2804498 | B1 | 7/2018 |
| JP | 2007-515950 | A | 6/2007 |
| JP | 2010-516243 | A | 5/2010 |
| RU | 2291642 | C1 | 1/2007 |
| RU | 2342846 | C2 | 1/2009 |
| WO | WO-86/03102 | A1 | 6/1986 |
| WO | WO-92/20307 | A1 | 11/1992 |
| WO | WO-2001/49124 | A1 | 7/2001 |
| WO | WO-2002/076227 | A1 | 10/2002 |
| WO | WO-2002/076230 | A1 | 10/2002 |
| WO | WO-2004/068965 | A1 | 8/2004 |
| WO | WO-2005/046363 | A2 | 5/2005 |
| WO | WO-2006/127772 | A2 | 11/2006 |
| WO | WO-2007/104573 | A2 | 9/2007 |
| WO | WO-2007/104574 | A2 | 9/2007 |
| WO | WO-2008/103935 | A2 | 8/2008 |
| WO | WO-2008/133982 | A2 | 11/2008 |
| WO | WO-2009/048522 | A1 | 4/2009 |
| WO | WO-2009/114034 | A1 | 9/2009 |
| WO | WO-2011/063338 | A2 | 5/2011 |
| WO | WO-2011/139943 | A1 | 11/2011 |
| WO | WO-2012/175085 | A1 | 12/2012 |
| WO | WO-2013109931 | A2 | 7/2013 |
| WO | WO-2013109961 | A1 | 7/2013 |

OTHER PUBLICATIONS

United States Office Action for corresponding U.S. Appl. No. 15/943,096 dated Feb. 8, 2019.

Chinese Final Office Action for corresponding Application No. 201710270107.1 dated Nov. 8, 2018.

United States Office Action for corresponding U.S. Appl. No. 15/850,494 dated Apr. 2, 2019.

European Notice of Opposition Against European Patent No. 2804897, dated Apr. 13, 2017, 22 pages.

Extended European Search Report in European ApplicationNo. 16178530.8, dated Aug. 8, 2016.

List and Schmidt, "Medicinal leaves and herbs," Phytopharmaceutical Technology 1989, p. 94.

Russian Office Action in Russian Application No. 2014134071, dated Jan. 26, 2017, 20 pages (with English translation).

Chinese Office Action in Chinese Application No. 201380014374.2, dated Jun. 2, 2016, 16 pages.

Chinese Office Action in Chinese Application No. 201380014374.2, dated Jan. 14, 2016, 14 pages (English translation only).

Dictionary of Chemistry and Chemical Technology, 2003, 4 pages (Chinese only).

Chinese Office Action in Chinese Application No. 201380014374.2, dated Jun. 18, 2015, 12 pages (English translation only).

Australian Office Action in Australian Application No. 2013204417, dated Dec. 5, 2014, 4 pages.

(56) References Cited

OTHER PUBLICATIONS

Chinese Office Action in Chinese Application No. 201210167508.1, dated Oct. 10, 2014, 2 pages.
Fibersol, http://www.fibersol.com/products/fibersol-2/,Oct. 2012.
International Preliminary Report on Patentability for PCT/US2013/022204 dated Jul. 22, 2014, 12 pages.
International Preliminary Report on Patentability for PCT/US2013/022252 dated Jul. 22, 2014, 9 pages.
Chinese Office Action in Chinese Application No. 201210167206.4, dated May 22, 2014, 11 pages.
Second Chinese Office Action in Chinese Application No. 201210167332.X, dated May 30, 2014, 5 pages.
Second Chinese Office Action in Chinese Application No. 201210167508.1, dated May 30, 2014, 2 pages (English translation only).
Chinese Office Action in Chinese Application No. 201210167166.3, dated May 22, 2014, 4 pages.
Chinese Office Action in Chinese Application No. 201210167508.1, dated Dec. 4, 2013, 8 pages.
Chinese Office Action in Chinese Application No. 201210167234.6, dated Jul. 19, 2013, 10 pages.
Chinese Office Action in Chinese Application No. 201210167332.X, dated Dec. 4, 2013, 10 pages.
International Search Report and Written Opinion for PCT/US2013/022252 dated Mar. 6, 2013, 12 pages.
International Search Report and Written Opinion for PCT/US2013/022204 dated Dec. 16, 2013, 17 pages.
Krochta et al., "Edible and Biodegradable Polymer Films: Challenges and Opportunities," Food Technology, 1997, 51:61-74.
Tso, Tobacco Production, "Seed to Smoke," Chemistry and Technology, Blackwell Publishing, 1991, 1-31.
Office Action for corresponding Chinese Application No. 201380014655.8 dated Aug. 31, 2018, English translation thereof.
Observations in preparation for Oral Proceedings in Opposition Against EP Application No. 2804897 dated Aug. 17, 2018.
Recommendations for the characterization of porous solids, Pure & Appl. Chem., vol. 66, No. 8, pp. 1739-1758, 1994.
Porosity and Specific Surface Area Measurements for Solid Materials, P. Klobes, K. Meyer, R. Munro, NIST, Sep. 2006.
Petrophysics MSc Course Notes—Porosity, Dr. Paul Glover.
Evaluation of five methods for measuring mean fibre diameter of fleece samples from New Zealand sheep, R.N. Andrews, H. Hawker, S. F. Crosbie, New Zealand Journal of Experimental Agriculture, 15:1, 23-31, 1987.
Fibre Length, SGS Wool Testing Services, 2011.
Summons to Attend Oral Proceedings Pursuant to Rule 115(1) EPC dated Feb. 2, 2018.
Communication of Notices of Opposition (R.79(2) EPC) dated Jun. 6, 2017.
Response to Communication Pursuant to Rule 115(1) EPC, Opposition against EP2804897, dated Jun. 26, 2018.
Certified Copy of Priority Document dated Sep. 19, 2012.
Submission in Opposition Proceedings for application No. EP13702700.9 dated Oct. 16, 2017.
Microcrystalline Cellulose, 46$^{th}$ JECFA (1996).
Brief Communication for application No. EP13702700.9-1102 dated Jul. 2, 2018.
Responsive to the Summons to Attend Oral Proceedings pursuant to Rule 115(1) EPC dated Feb. 2, 2018 Based on PCT/US2013/022252 dated Jun. 28, 2018.
Pilot Spinning of Viscose Staple Fibres., Johanna Eriksson, Degree Project in Engineering Chemistry, Umea University, Dated May 2015.
Observations submitted in Opposition against EP2809897 dated Jun. 26, 2018.
Extended European Report for corresponding Application No. 18185575.0-1102 dated Dec. 20, 2018.
Canadian Office Action for corresponding Application No. 2,861,995 dated Dec. 7, 2018.
United States Office Action for U.S. Appl. No. 15/816,506 dated Dec. 21, 2018.
Russian Office Action for corresponding Application No. 2014134071 dated Sep. 26, 2018 with English translation thereof.
Canadian Office Action for corresponding Application No. 2,861,992, dated Jun. 14, 2019.
United States Office Action for corresponding U.S. Appl. No. 15/816,506, dated Jul. 12, 2019.
Notice of Opposition for corresponding European Application No. 16178530.8-1102/3098258, dated May 9, 2019.
United States Notice of Allowance for corresponding U.S. Appl. No. 15/943,096, dated Jun. 10, 2019.
Japanese Notice of Reasons for Rejection for corresponding Application No. 2018-032700, dated Jun. 3, 2019.
European Office Action for corresponding Application No. 18185575.0-1102, dated Sep. 5, 2019.
Chinese Reexamination Notice for corresponding Application No. 201710270107.1, dated Nov. 5, 2019.
United States Office Action for U.S. Appl. No. 15/816,506, dated Oct. 25, 2019.
United States Office Action for U.S. Appl. No. 15/850,494, dated Oct. 1, 2019.
Food Applications, International Fiber Corporation, http://buyersguide.supplysideshow.com/media/54/library/49964-313.pdf (Year: 2010).
United States Notice of Allowance for U.S. Appl. No. 15/943,096, dated Dec. 18, 2019.
United States Notice of Allowance for U.S. Appl. No. 15/816,506, dated Jan. 29, 2020.
European Office Action for corresponding Application No. 18174632.2-1105, dated Jan. 23, 2020.
European Office Action for corresponding Application No. 18185575.0-1102, dated Jan. 24, 2020.
United States Notice of Allowance for U.S. Appl. No. 15/850,494, dated Jan. 14, 2020.

* cited by examiner

110A

110B

110C

110D

110E

110F

ORAL TOBACCO PRODUCT

CROSS-REFERENCE TO RELATED APPLICATIONS

This application is a continuation of U.S. application Ser. No. 13/745,073, filed on Jan. 18, 2013, which claims priority to U.S. Provisional Application Ser. No. 61/588,851 filed Jan. 20, 2012, which is incorporated by reference in its entirety.

TECHNICAL FIELD

This document relates to oral tobacco products including mouth-stable polymers and tobacco fibers.

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

This specification describes an oral tobacco product that provides a satisfying tactile and/or flavor experience. The oral tobacco product includes a body that is at least partially receivable in an oral cavity of an adult tobacco consumer. In some embodiments, the body includes a mouth-stable polymer matrix and tobacco fibers embedded in the stable polymer matrix.

These and other embodiments can each optionally include one or more of the following features. In some embodiments, the oral tobacco product's body includes at least 10 weight percent of the mouth-stable polymer. The mouth-stable polymer matrix can include polyurethane, silicon polymer, polyester, polyacrylate, polyethylene, poly(styrene-ethylene-butylene-styrene) ("SEBS"), poly(styrene-butadiene-styrene) ("SBS"), poly(styrene-isoprene-styrene) ("SIS"), and other similar thermoplastic elastomers, or any copolymer, mixture, or combination thereof. The oral tobacco product can also include a plasticizer dispersed in the mouth-stable polymer matrix. For example, the plasticizer can be propylene glycol, glycerin, vegetable oil, triglycerides, or a combination thereof. The oral tobacco product can also include a sweetener dispersed in the body. The sweetener can be saccharine, sucralose, aspartame, acesulfame potassium, or a combination thereof.

The oral tobacco product, according to certain embodiments, includes one or more additives. For example, the oral tobacco product can include an additive selected from the group consisting of minerals, vitamins, dietary supplements, nutraceuticals, energizing agents, soothing agents, amino acids, chemesthetic agents, antioxidants, botanicals, teeth whitening agents, therapeutic agents, or a combination thereof. The nicotine and/or other additives can be absorbed into the cellulosic fibers and polymer matrix.

The oral tobacco product's body can have at least 10 weight percent tobacco fibers. In some embodiments, the oral tobacco product can also include non-tobacco cellulosic fibers. For example, the cellulosic fibers can be selected from the following: sugar beet fiber, wood pulp fiber, cotton fiber, bran fiber, citrus pulp fiber, grass fiber, willow fiber, poplar fiber, and combinations thereof. The cellulosic fibers may also be chemically treated prior to use. For example, the non-tobacco cellulosic fibers can be CMC, HPMC, HPC, or other treated cellulosic material.

The oral tobacco product can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang-ylang, sage, fennel, pimenta, ginger, anise, coriander, coffee, mint oils from a species of the genus *Mentha*, cocoa, and combinations thereof. Synthetic flavorants can also be used. The particular combination of flavorants can be selected from the flavorants that are generally recognized as safe ("GRAS") in a particular country, such as the United States. Flavorants can also be included in the oral tobacco product as encapsulated flavorants.

The body of the oral tobacco product can have a variety of different shapes, some of which include disk, shield, rectangle, and square. According to certain embodiments, the body can have a length or width of between 5 mm and 25 mm and a thickness of between 1 mm and 10 mm.

The oral tobacco product's body can be compressible and springy. In some embodiments, the body has a compressibility @ 250 N of less than 95%, less than 90%, less than 85%, or less than 80%. In some embodiments, the body has a compressibility of @ 250 N of between 45% and 90%. The oral tobacco product's body can have a compressibility @ 425 N of less than 99%. For example, the body can have a compressibility @ 425 N of between 60% and 98%. The body can also have a percentage of springiness of at least 20%, at least 30%, at least 40%, at least 50%, at least 60%, at least 70%, or at least 75%. For example, the body can have a percentage of springiness of between 75% and 90%.

The oral tobacco product can also include an antioxidant. In some embodiments, the oral tobacco product includes between 0.01 weight percent and 5.0 weight percent antioxidant. Suitable antioxidants include ascorbyl palmitate, BHT, ascorbic acid, sodium ascorbate, monosterol citrate, tocopherols, propyl gallate, tertiary butylhydroquinone (TBHQ), butylated hydroxyanisole (BHA), Vitamin E, and derivatives thereof. An antioxidant can reduce the formation of nicotine-N-oxide.

The oral tobacco product can include a combination of soluble fibers and tobacco fibers. In some embodiments, a ratio of soluble fiber to tobacco fibers can be between 1:60 and 60:1. In some embodiments, the soluble fibers can include maltodextrin. In some embodiments, the soluble fibers comprise starch. The soluble fibers can be derived from corn. In general, another aspect of the subject matter described in this specification is methods of making and using the oral tobacco product. The methods of making the oral tobacco product can include the actions of extruding a mouth-stable polymer having tobacco fibers dispersed therein.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
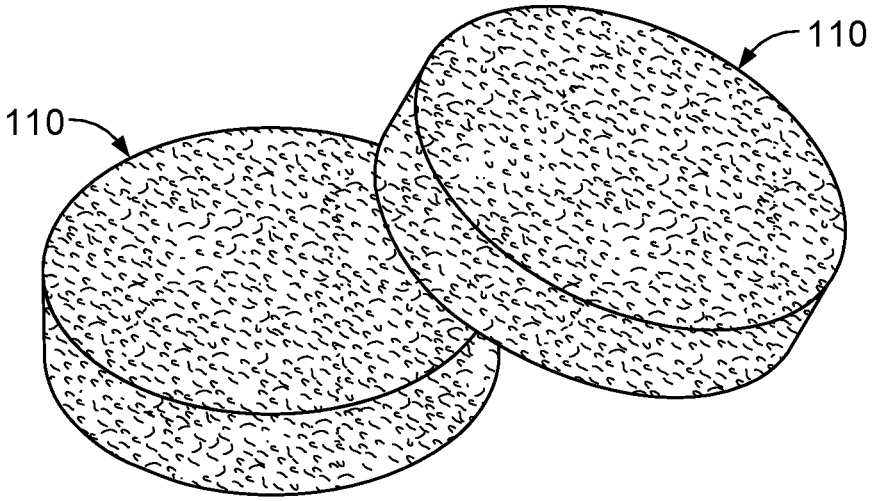
FIG. 1 is a perspective view of a pair of oral tobacco products.

The oral tobacco products described herein include a mouth-stable polymer matrix and tobacco fibers. The oral tobacco products described herein can provide a favorable tobacco experience.

Suitable mouth-stable polymers include thermoplastic elastomers such as polyurethane. As used here, the term "mouth stable" means that the polymer does not appreciably dissolve or disintegrate when exposed to saliva within an oral cavity and at the normal human body temperature (e.g., about 98.6° F.) over a period of one hour. In addition to biostable polymers, mouth-stable polymers can include biodegradable polymers that breakdown over periods of days, weeks, months, and/or years, but do not appreciably break down when held in an oral cavity and exposed to saliva for a period of one hour. In some embodiments, the mouth-stable polymer is stable within an oral cavity and exposed to saliva at the normal human body temperature for a period of at least 6 hours, at least 12 hours, at least 24 hours, or at least 2 days. Accordingly, the oral tobacco products described herein can remain intact when placed within an oral cavity during a use period. After use, the mouth-stable polymer matrix can be removed from the oral cavity and discarded.

The mouth-stable polymer can have shape stability. In some cases, the oral tobacco product 110 can be chewed without significant and instantaneous permanent plastic deformation. As the oral tobacco product 110 is chewed, it can become more pliable. Some embodiments of the oral tobacco product 110 can be adapted to remain non-sticky during and after use. After prolonged use, certain embodiments of the oral tobacco product 110 will expand and become flatter. The oral tobacco product, however, can retain the essence of its original shape.

One or more additives are included in the oral tobacco product and adapted to be released from the oral tobacco product when the oral tobacco product is placed in an oral cavity. The oral tobacco product, in some embodiments, includes added nicotine and/or other additives. The tobacco fibers can help to provide access to the tobacco, additives, sweeteners, and/or flavorants throughout the oral tobacco product as well as to other ingredients in the oral tobacco product. As will be discussed below, fibers can provide channels for additives, sweeteners, and/or flavorants to leach out of the mouth-stable polymer matrix. The tobacco fiber-polymer matrix can absorb one or more additives and provide a pathway for one or more additives to be released from the oral tobacco product. The tobacco fiber-polymer matrix can be porous. In some embodiments, the tobacco fiber-polymer matrix can have a plurality of pores having a pore diameter of between 40 microns and 60 microns and a plurality of pores having a pore diameter of between 1 micron and 10 microns. During use, saliva can be absorbed into the fiber-polymer matrix to release the tobacco constituents. The absorbed saliva can enter the pores and/or cause the tobacco fibers to expand, which can facilitate further release of tobacco constituents, additives, sweeteners, and/or flavorants. Mechanical action (e.g., chewing) of the oral tobacco product can facilitate the release of the additives, sweeteners, and/or flavorants.

In addition to additives, sweeteners, and flavorants, the oral tobacco product can also include fillers, plasticizers, and/or processing aids. Fillers can also be included in the mouth-stable polymer matrix to alter the texture or pliability of the oral tobacco product. The mouth-stable polymer matrix can also include plasticizers, which can increase the softness of the oral tobacco product. Non-tobacco cellulosic fibers can also be included to alter the properties of the oral tobacco product. Processing aids can also be present in the oral tobacco product and be used to facilitate shaping processes.

Oral Tobacco Product Shapes and Packaging

FIG. 1 depicts an example of an oral tobacco product 110. The oral tobacco product 110 has a disk shape. For example, the oral tobacco product 110 can have a diameter of about 12 mm and a thickness of about 2.5 mm.

Figure 2A:
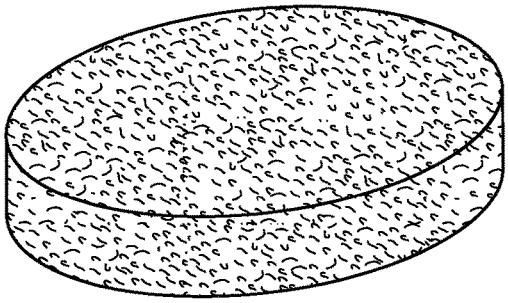
FIGS. 2A-2O illustrate various exemplary shapes of oral tobacco products.
Figure 2B:
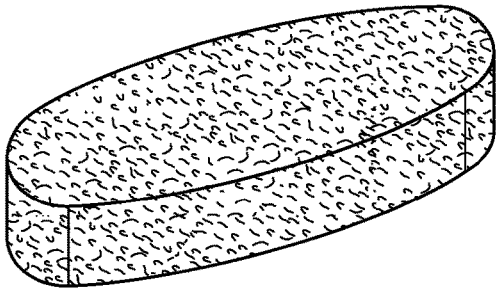
Figure 2C:
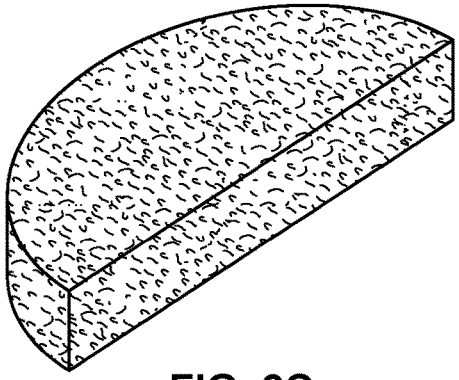
Figure 2D:
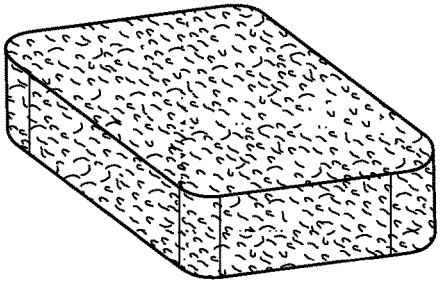
Figure 2E:
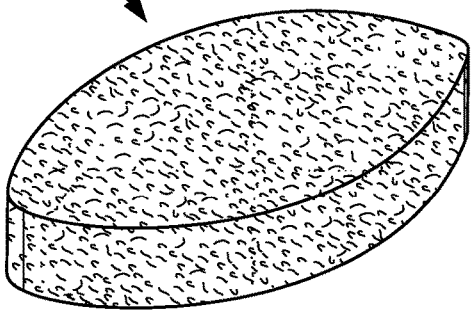
Figure 2F:
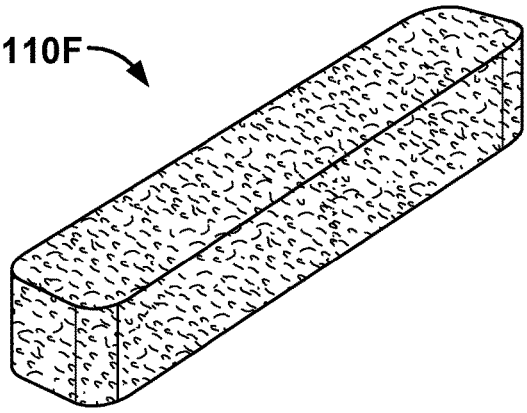
Figure 2G:
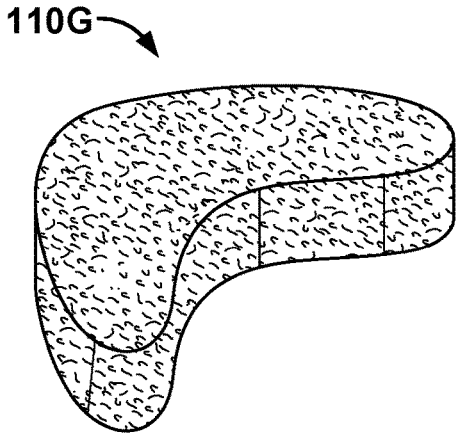
Figure 2H:
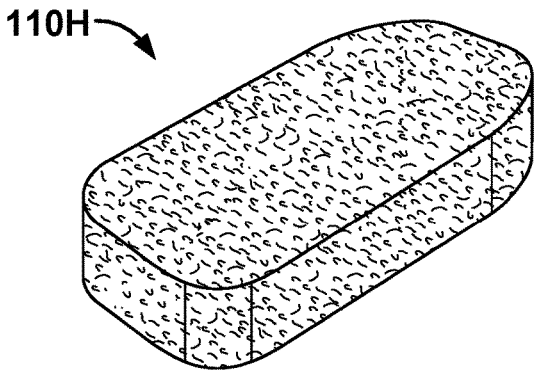
Figure 2I:
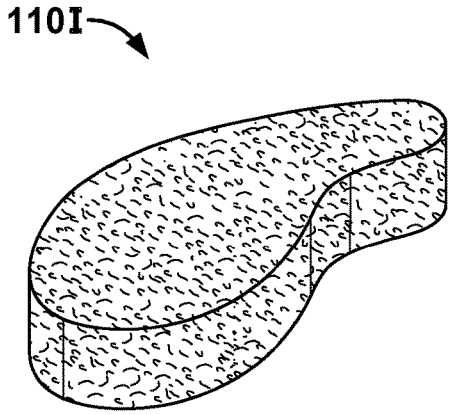
Figure 2J:
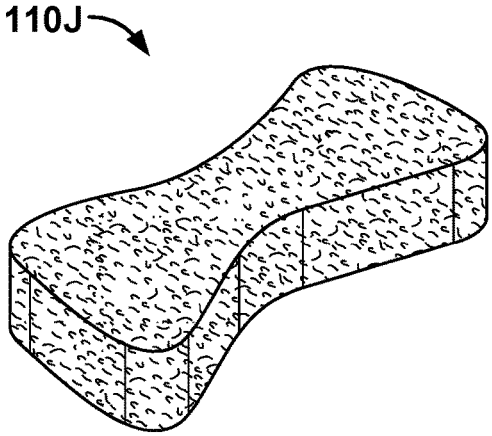
Figure 2K:
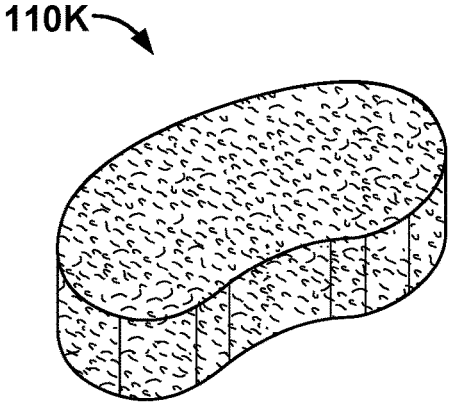
Figure 2L:
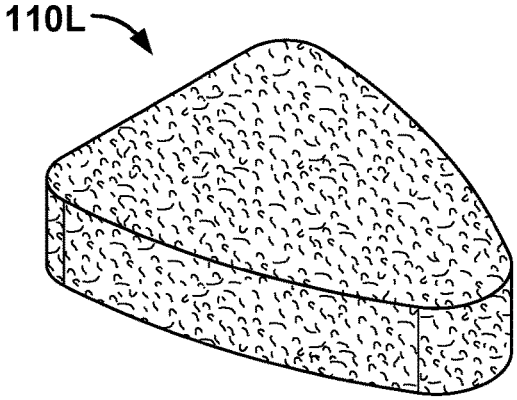
Figure 2M:
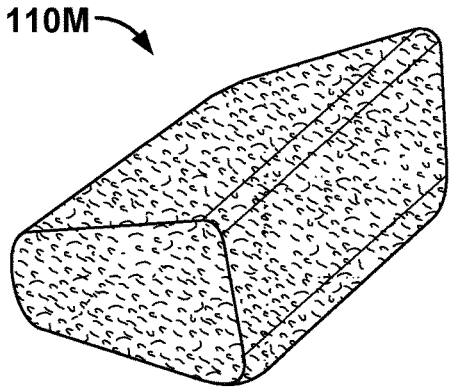
Figure 2N:
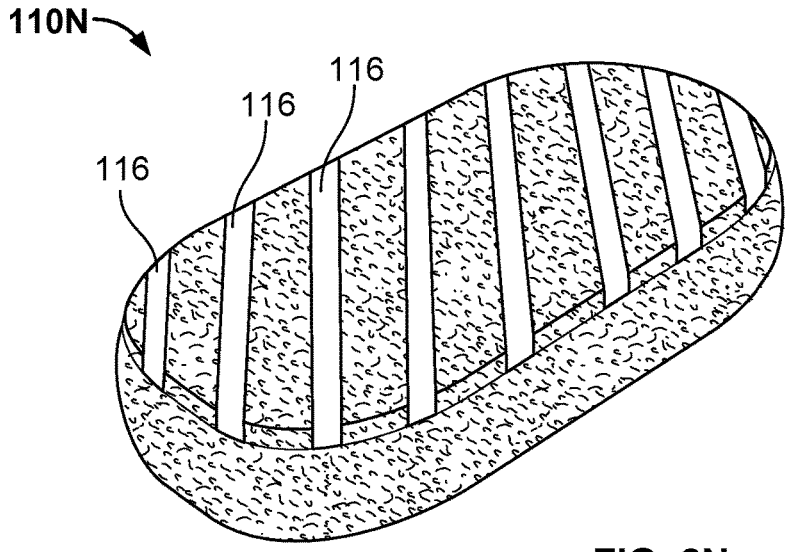

Referring now to FIGS. 2A-2N, the oral tobacco product 110 can be molded into any desired shape. For example, referring to FIGS. 2A-2L, the oral tobacco product 110A-L can be formed in a shape that promotes improved oral positioning in the oral cavity, improved packaging characteristics, or both. In some circumstances, the oral tobacco product 110A-L can be configured to be: (A) an elliptical-shaped oral tobacco product 110A; (B) an elongated elliptical-shaped oral tobacco product 110B; (C) semi-circular oral tobacco product 110C; (D) square or rectangular-shaped oral tobacco product 110D; (E) football-shaped oral tobacco product 110E; (F) elongated rectangular-shaped oral tobacco product 110F; (G) boomerang-shaped oral tobacco product 110G; (H) rounded-edge rectangular-shaped oral tobacco product 110H; (I) teardrop- or comma-shaped oral tobacco product 110I; (J) bowtie-shaped oral tobacco product 110J; (K) peanut-shaped oral tobacco product 110K; and (L) shield-shaped oral tobacco product. Alternatively, the oral tobacco product can have different thicknesses or dimensionality, such that a beveled article (e.g., a wedge) is produced (see, for example, product 110M depicted in FIG. 2M) or a hemi-spherical shape is produced. In some embodiments, the oral tobacco product has a shield shape.

In addition or in the alternative to flavorants being included within the mouth-stable polymer matrix, flavorants can be included on an exterior of the oral tobacco product 110. For example, referring to FIG. 2N some embodiments of an oral tobacco product 110N can be equipped with flavor strips 116.

Figure 2O:
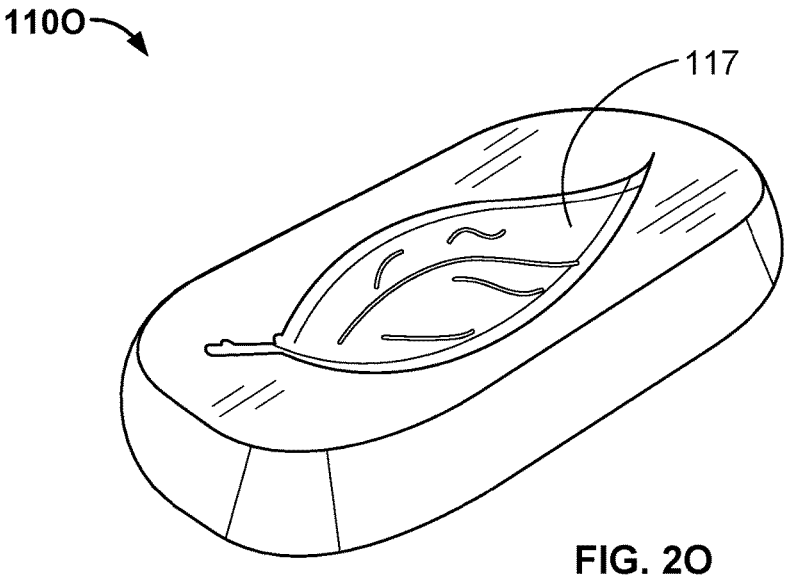

Referring to FIG. 2O, particular embodiments of the oral tobacco product 110 can be embossed or stamped with a design (e.g., a logo, an image, or the like). For example, the oral tobacco product 110O can be embossed or stamped with any type of design 117 including, but not limited to, a trademark, a product name, or any type of image. The design 117 can be formed directly into the oral tobacco product, arranged along the exterior of the product 110O. The design 117 can also be embossed or stamped into those embodiments with a dissolvable film 116 applied thereto.

In some embodiments, the oral tobacco product 110 or products 110A-O can be wrapped or coated in an edible or dissolvable film, which may be opaque, substantially transparent, or translucent. The dissolvable film ran readily dissipate when the oral tobacco product 110 is placed in an oral cavity. In some embodiments, the oral tobacco product 110 can be coated with a mouth-stable material. Exemplary coating materials include Beeswax, gelatin, acetylated monoglyceride, starch (e.g., native potato starch, high amylose starch, hydroxypropylated potato starch), Zein, Shellac, ethyl cellulose, methylcellulose, hydroxypropyl methylcellulose, carboxymethyl cellulose, and combinations thereof. For example, a coating can include a combination of gelatin and methylcellulose. In some embodiments, a coating material can include a plasticizer. In some case, a coating can include a colorant, a flavorant, and/or a one or more of the additives discussed above. For example, a coating can include nicotine to provide a user with an initial nicotine burst. In some cases, the matrix of mouth-stable polymer 120 can have surfaces roughened to improve the adherence of a coating. In some cases, a coating can provide a glossy or semi-glossy appearance, a smooth surface, and/or an appealing visual aesthetic (e.g., a nice color). In some embodiments, the coating (e.g., a beeswax, Zein, acetylated monoglyceride, and/or hydroxypropylated potato starch coating) can provide soft mouth feel. In some embodiments, the coating (e.g., a methylcellulose, hydroxypropyl methylcellulose, carboxymethyl cellulose, ethyl cellulose, and/or gelatin coating) can provide a hard outer coating.

One or more oral tobacco products 110 can be packaged in a variety of conventional and non-conventional manners. For example, a plurality of oral tobacco products 110 can be packaged in a container having a lid. In other embodiments, a plurality of oral tobacco products 110 can be stacked and packaged in a paper, plastic, and/or aluminum foil tube. The packaging can have a child-resistant lid.

Figure 3A:
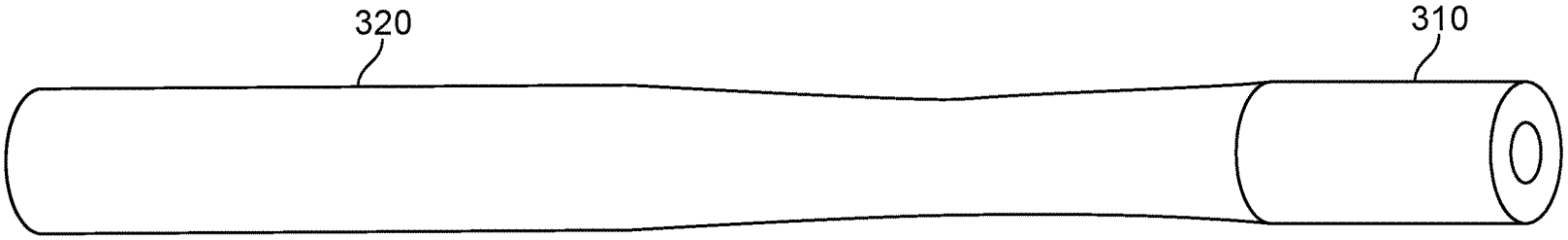
FIG. 3A-3J illustrate oral tobacco products having various rod, stick, or tube configurations.
Figure 3B:
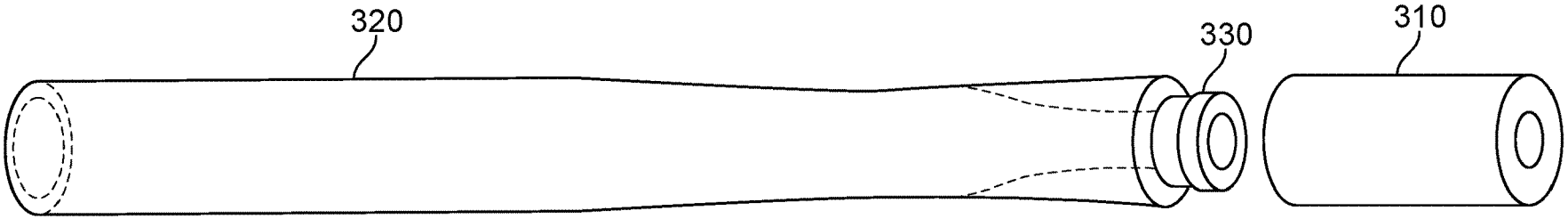

The oral tobacco product 110 can also include additional elements. In some embodiments, a mouth-stable polymer matrix including tobacco fibers can be attached to a rod, tube, or stick. For example, FIGS. 3A-3J illustrate tubes attached to a mouth-stable polymer matrix tips. FIG. 3A depicts an embodiment of an oral tobacco product having a tip piece 310 and a tube piece 320. The tip piece 310 can include the mouth-stable polymer matrix having fibers and/or one or more additives within the polymer matrix. The tip piece 310 can be sized and shaped to be at least partially received in an oral cavity. The tube piece 320 can be made of any conventional polymer. During use the tube piece 320 can act as holder for the tip piece 310. The tube piece 320 and the tip piece 310 can be attached by a snap-fit attachment feature 330, as shown in FIG. 3B.

Figure 3C:
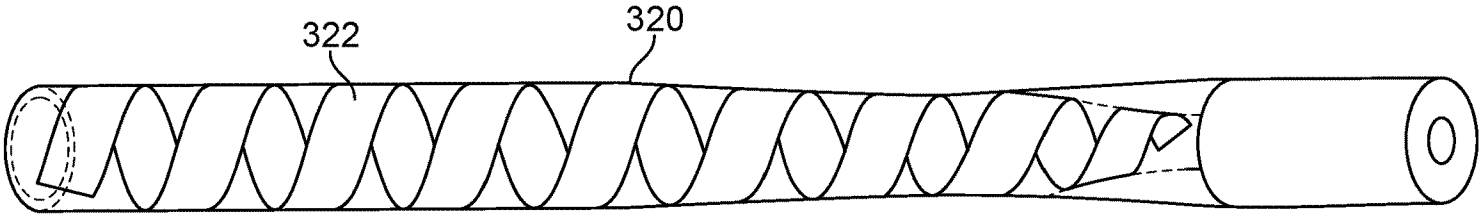
Figure 3D:
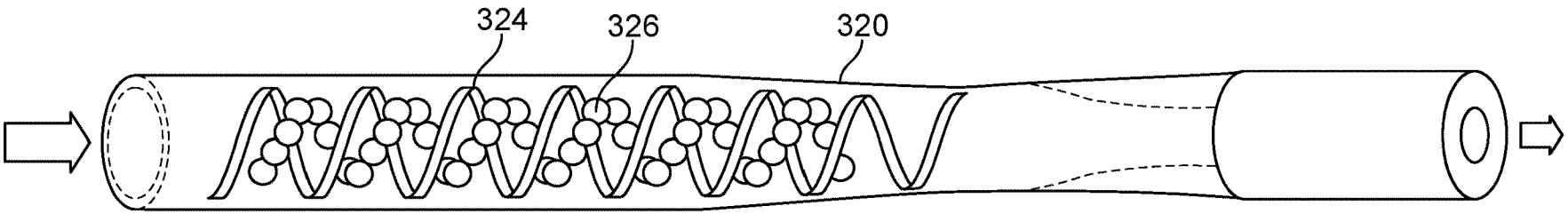
Figure 3E:
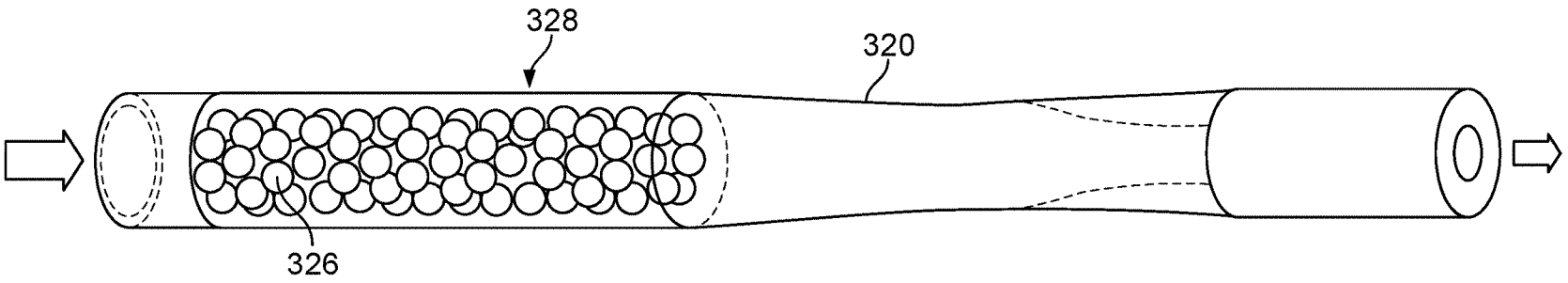
Figure 3F:
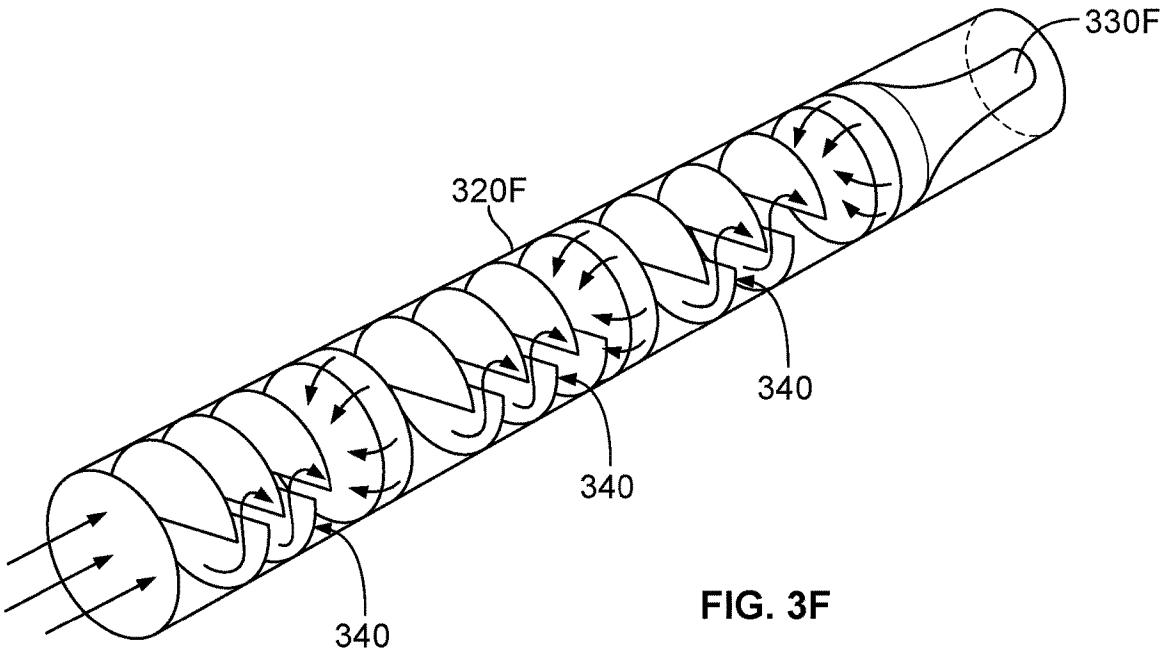

The tube piece 320 can be reusable. For example, multiple tip pieces 310 can be packaged with a single tube piece 320 and a user can switch off the tip pieces 310. In other embodiments, the tube pieces 320 can be intended for a single use. In some embodiments, the tube pieces 320 can include flavorants within the tube. The flavorants can be adapted to be released when air is drawn through the tube 320. For example, FIG. 3C depicts a tube including a flavor ribbon 322. FIG. 3D depicts a tube 320 including a flavor strip 324 and a plurality of flavor beads 326. FIG. 3E depicts a tube 320 including a compressed mass 328 of flavor beads 326. In some embodiments, the inside of the tube can have structure adapted to alter the flow pattern of air drawn into the tube. For example, FIG. 3F depicts a tube 320F having a series of steps and constrictions 340 adapted to alter the flow pattern of air drawn into the tube. FIG. 3F also depicts an alternative connection feature 330F.

Figure 3G:
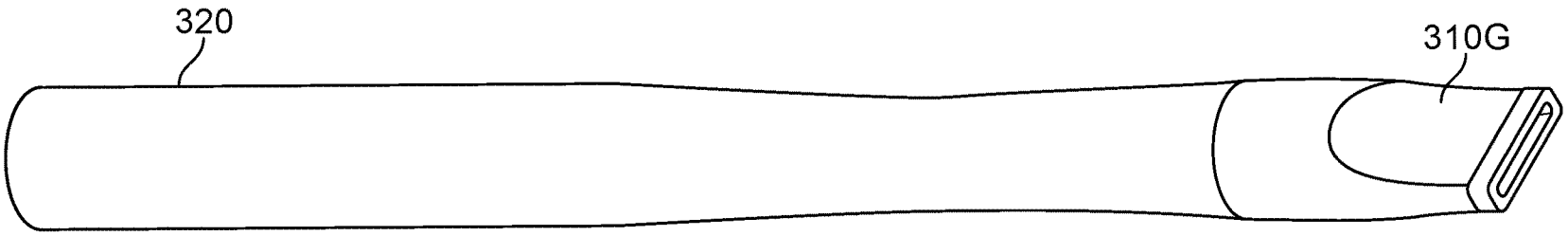

FIG. 3G depicts an embodiment having a recorder-like shape. As shown, a tip piece 310G is connected to the contoured tube piece 320. For example, the recorder-shaped tip 310G can be composed of a mouth-stable polymer matrix that includes tobacco fibers, one or more sweeteners, and one or more flavorants. As shown, the tip piece 310G is sized and shaped to be at least partially received within an adult's oral cavity.

Figure 3H:
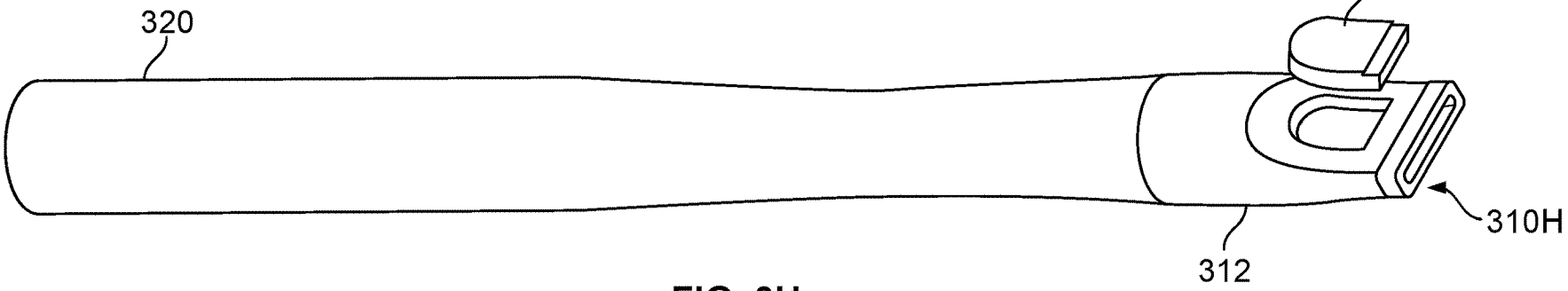
Figure 3I:
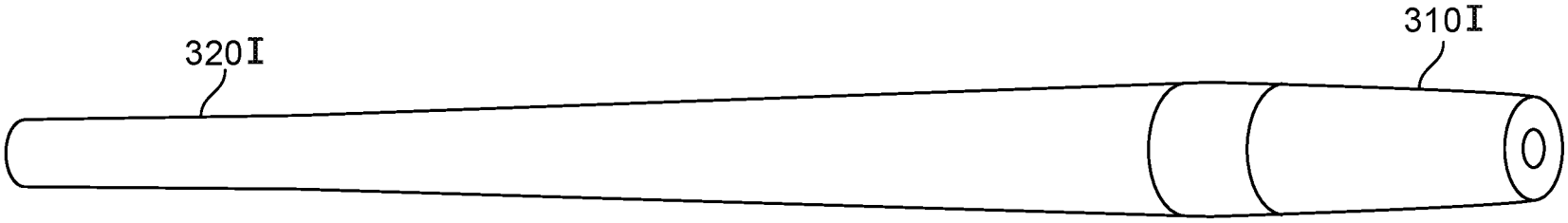
Figure 3J:
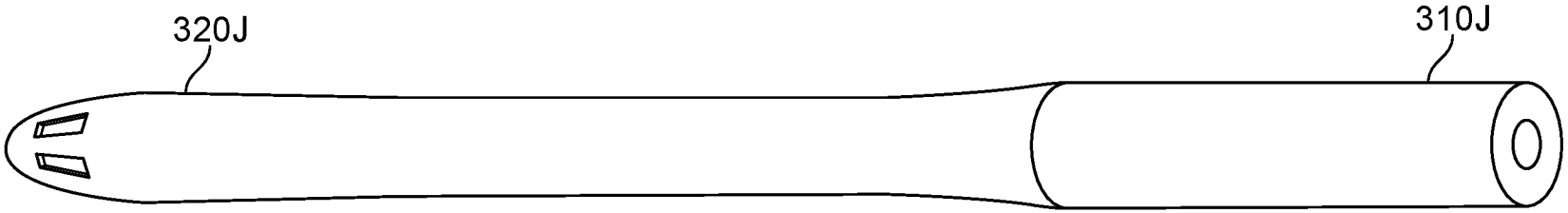

FIG. 3H depicts a similarly shaped oral tobacco product having a plastic recorder-shaped tip 310H that includes a reusable plastic part 312 and a mouth-stable polymer matrix part 315 having tobacco fibers dispersed therein. FIGS. 3I and 3J depict embodiments having alternatively shaped tip pieces 310I and 310J. FIG. 3I depicts an embodiment having a tapered tube 320I. FIG. 3J depicts an embodiment having vent holes at the non-tip end of the tube piece 320J.

In some embodiments, a system or kit of different tubes and rods and/or different tips can be packaged together, each having the same type of attachment features. Embodiments having each of the combinations of tips and tubes or rods shown in FIGS. 3A-3J are contemplated.

Oral Tobacco Product Properties

The oral tobacco product 110 can provide a favorable tactile experience (e.g., mouth feel). The oral tobacco product 110 can also retain its shape during processing, shipping, handling, and optionally use. As noted above, the oral tobacco product 110 includes a mouth-stable polymer matrix that does not appreciably dissolve or disintegrate when placed in an oral cavity and exposed to saliva. In some embodiments, the oral tobacco product 110 can have an elasticity allowing an adult tobacco consumer to work the product within the mouth. In some embodiments, the oral tobacco product 110 has at least some shape memory and thus can return to shape after being squeezed between teeth in an oral cavity. Working of the oral tobacco product 110 within the oral cavity can accelerate the release of the tobacco constituents, additives, sweeteners, and/or flavorants within the mouth-stable polymer matrix.

During use, the oral tobacco product 110 can absorb saliva into the polymer-fiber matrix. The saliva can cause the polymer-fiber matrix to swell, which can further increase access to different sections of the polymer-fiber matrix. Physical activity, such as chewing of the oral tobacco product in the mouth, can also accelerate the polymer-matrix swelling and therefore the release of additives. As the oral tobacco product is chewed, saliva can access different sections of the polymer-fiber matrix. The mouth-stable polymer can have shape stability. In some cases, the oral tobacco product 110 can be chewed without significant and instantaneous permanent plastic deformation (such as that experienced by a chewing gum when chewed). As the oral tobacco product 100 is chewed, it can become more pliable and additional additives can become available for release into the oral cavity. Some embodiments of the oral tobacco product 110 can be adapted to remain non-sticky during and after use. After prolonged use, certain embodiments of the oral tobacco product 110 will expand and become flatter. The oral tobacco product, however, can retain the essence of its original shape. The amount of deformation will depend on the duration of use and an amount of mouth force used. As the product is used, it can increase in both weight and volume, due to the swelling. With greater the physical manipulation, the oral tobacco product 110 will have a greater amount of swelling and thus have a larger weight gain. In certain embodiments, the oral tobacco product 110 will have an increase in weight of between 4 and 75 percent when chewed by an adult consumer for 30 minutes.

One way of characterizing the properties of the oral tobacco product is by measuring the compressibility and springiness of the product. The compressibility can be calculated as a percentage of reduction in thickness of the sample when the sample is compressed with a standardized probe with a particular force. As used herein, the term "compression @ 250 N test" defines a test of a sample where the sample is placed on a flat stationary surface and twice compressed with a 10 mm-diameter-sphere-tipped probe with a force of 250 N with a hold time of 30 seconds between compressions. The "percentage of compression @ 250 N" is the maximum amount of reduction in thickness of the sample during the compression @250 N test. For example, if a 3 mm thick sample is compressed to a minimum thickness of 1.5 mm during either of the two compressions, the sample is said to have a 50% compression @ 250 N. As used herein, the term "compression @ 425 N test" defines a test of a sample where the sample is placed on a flat stationary surface and twice compressed with a 10 mm-diameter-sphere-tipped probe with a force of 425 N with a hold time of 30 seconds between compressions. For comparison, a normal human bite force is typically between 400 and 500 N.

In some embodiments, the oral tobacco product 110 has a percentage of compression @250 N of less than 95%. In certain embodiments, the oral tobacco product 110 has a percentage of compression @ 250 N of less than 90%, less than 85%, or less than 80%. In certain embodiments, the oral tobacco product 110 has a percentage of compression @ 250 N of at least 10%, at least 25%, or at least 40%. For example, the oral tobacco product can have a percentage of compression @ 250 N of between 45% and 80%. In some embodiments, the oral tobacco product 110 has a percentage of compression @ 425 N of less than 99%. In certain embodiments, the oral tobacco product 110 has a percentage of compression @ 425 N of less than 98%, less than 97%, or less than 96%. In certain embodiments, the oral tobacco product 110 has a percentage of compression @ 425 N of at least 10%, at least 25%, at least 50%, or at least 60%. For example, the oral tobacco product can have a percentage of compression @ 425 N of between 65% and 98%.

The springiness of a sample can be measured by measuring the percentage of recovery after a sample is compressed. As used herein, the term "percentage of springiness" means the percentage of thickness recovery of the sample during a 30 second recovery time after being compressed by the compression @ 425 N test using the 10 mm-diameter-sphere-tipped probe. For example, if a sample is compressed from an original thickness of 3.0 mm to a thickness of 2.0 mm and then recovers to 2.5 mm after 30 seconds, the springiness of the sample would be 50%. In some embodiments, the oral tobacco product 110 has a percentage of springiness of at least 20%. In certain embodiments, the oral tobacco product 110 has a percentage of springiness of at least 40%, at least 50%, at least 60%, at least 70%, at least 75%, or at least 80%. In certain embodiments, the percentage of springiness is less than 95%, less than 90%, or less than 87%. For example, the oral tobacco product can have a percentage of springiness of between 75% and 90%.

The particular materials used in the oral tobacco product 110 and the processing techniques discussed below can have an impact on the compressibility and springiness of the oral tobacco product. In addition to different materials have different compressibility and springiness properties, the incorporation of air bubbles or channels, or different fillers and/or fibers can also have an impact on the elasticity and pliability of the oral tobacco product. Additionally, the material properties of the overall oral tobacco product 110 can change as tobacco constituents and/or other ingredients are released. In some embodiments, non-tobacco fibers and/or fillers can also dissolve or disintegrate during use and thus alter the material properties of the oral tobacco product 110 during use.

The oral tobacco product 110 can have a variety of colors. In some embodiments, natural and artificial coloring can be added to the mouth-stable polymer before or during the molding process to form oral tobacco products 110 having a predetermined color. Encapsulated flavors can be added during the extrusion process to create speckles, patterns or dots within the oral tobacco product.

Polymers

The mouth-stable polymer can be a variety of different biocompatible and biostable polymers. In some embodiments, the mouth-stable polymer is a polymer generally recognized as safe by an appropriate regulatory agency. In some embodiments, the polymer is a thermoplastic polymer. The polymer can also be a thermoplastic elastomer. For example, suitable mouth-stable polymers include polyurethanes, silicon polymers, polyesters, polyacrylates, polyethylenes, polypropylenes, polyetheramides, polystyrenes (e.g., acrylonitrile butadiene styrene, high impact polystyrenes (HIPS)) polyvinyl alcohols, polyvinyl acetates, polyvinyl chlorides, polybutyl acetates, butyl rubbers (e.g., polyisobutylenes), SEBS, SBS, SIS, and mixtures and copolymers thereof. In certain embodiments, the mouth-stable polymer is food-grade or medical-grade polymers (e.g., medical-grade polyurethane).

The mouth-stable polymer forms the mouth-stable polymer matrix of the oral tobacco product 110. In some embodiments, the oral tobacco product includes at least 10 weight percent of one or more mouth-stable polymers. In certain embodiments, the oral tobacco product includes at least 20 weight percent, at least 30 weight percent, at least 40 weight percent, at least 50 weight percent, at least 60 weight percent, at least 70 weight percent, at least 80 weight percent, or at least 90 weight percent of one or more mouth-stable polymers. In certain embodiments, the oral tobacco product includes between 10 and 90 weight percent of one or more mouth-stable polymers. Accordingly to some embodiments, the oral tobacco product includes between 40 and 80 weight percent of the mouth-stable polymers. Some embodiments of the oral tobacco product have between 55 and 70 weight percent polymers.

The mouth-stable polymer according to certain embodiments has a flexural modulus of at least 5 MPa when tested according to ASTM Testing Method D790 or ISO 178 at 23 degrees Celsius. In some embodiments, the flexural modulus is at least 10 MPa. For example, the flexural modulus can be between 10 MPa and 30 MPa. In some embodiments, the mouth-stable polymer is a grade that complies with food-contact regulations applicable in one or more countries (e.g., US FDA regulations). In some embodiments, the mouth-stable polymer can be a polyurethane, SIS, or other thermal plastic elastomer meeting the requirements of the FDA-modified ISO 10993, Part 1 "Biological Evaluation of Medical Devices" tests with human tissue contact time of 30 days or less. The mouth-stable polymer can have a shore Hardness of 50 D or softer, a melt flow index of 3 g/10 min at 200° C./10 kg, a tensile strength of 10 MPa or more (using ISO 37), and a ultimate elongation of less than 100% (using ISO 37).

Tobacco Fibers

Figure 4:
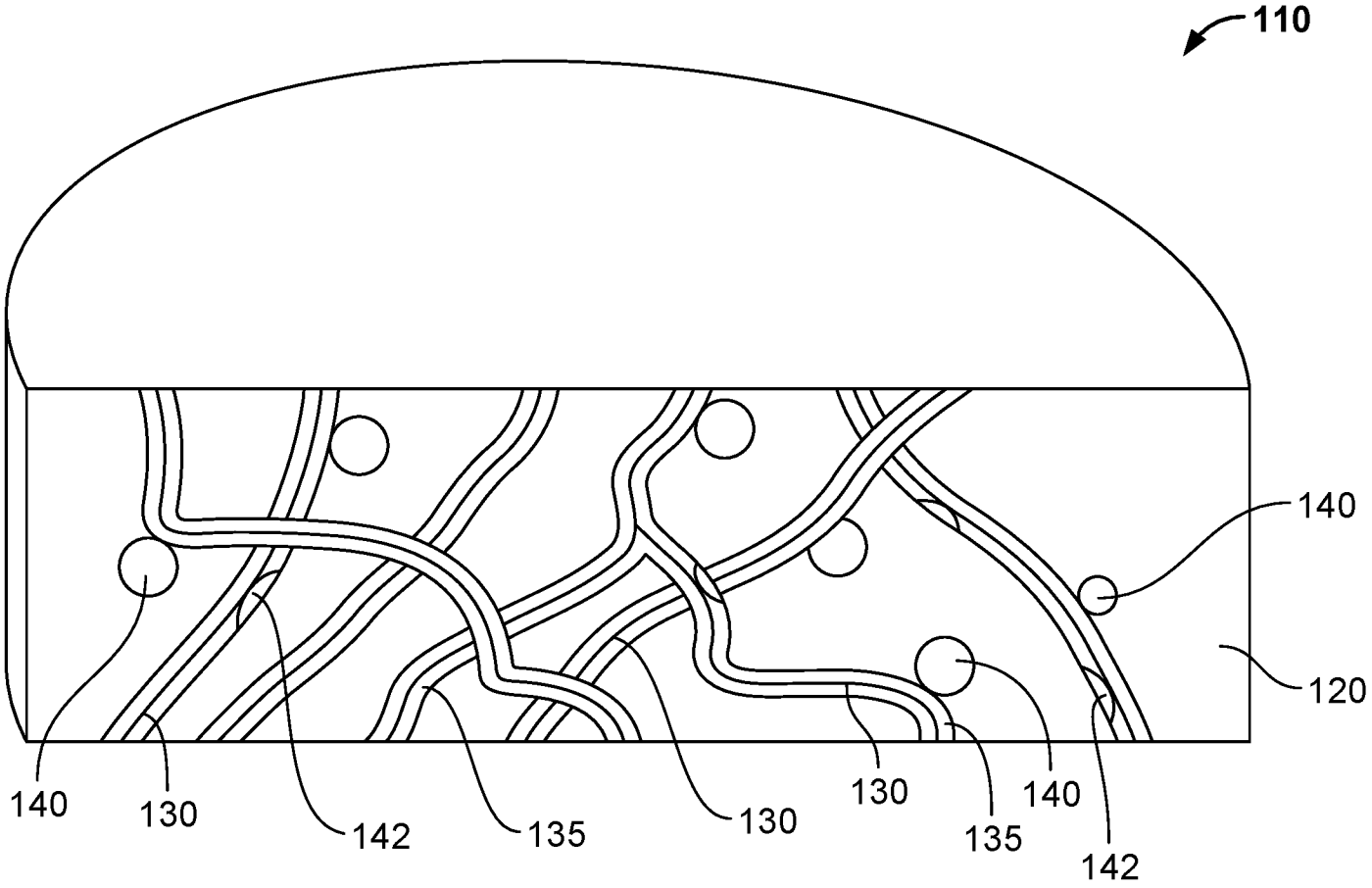
FIG. 4 illustrates a cross-section of a hypothetical oral tobacco product.

FIG. 4 depicts an illustration of how a plurality of tobacco fibers 130 can be dispersed in a mouth-stable polymer matrix 120. As will be discussed below, the tobacco fibers 130 can be mixed with the mouth-stable polymer prior to or during an extrusion process. Additives 140 can be present in the mouth-stable polymer matrix 120. As shown in FIG. 4, the tobacco fibers 130 provide passages in the mouth-stable polymer matrix, which can permit certain tobacco constituents and/or additives within the mouth-stable polymer matrix to be released into an oral cavity when the oral tobacco product is received in an oral cavity and exposed to saliva. The oral tobacco product 110 can also include channels 135 formed adjacent the tobacco fibers 130.

By "tobacco fibers" it is meant a part, e.g., leaves, and stems, of a member of the genus *Nicotiana* that cut, shredded, or otherwise processed to form fibers of tobacco plant tissue. Exemplary species of tobacco include *N. rustica, N. tabacum, N. tomentosiformis*, and *N. sylvestris*. For example, the tobacco fibers can be made by comminuting tobacco stems. The tobacco fibers can include cellulose, lignin, lipids, hemicellulose, and other tobacco constituents.

Suitable tobaccos include fermented and unfermented tobaccos. In addition to fermentation, the tobacco can be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include dark air-cured, dark fire cured, burley, flue cured, and cigar filler or wrapper, as well as the products from the whole leaf stemming operation. In some embodiments, the tobacco fibers includes up to 70% dark tobacco on a fresh weight basis. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the oral tobacco product. The tobacco, in some embodiments, is long cut fermented cured moist tobacco having an oven volatiles content of between 48 and 50 weight percent prior to mixing with the mouth-stable polymer and optionally flavorants and other additives.

The tobacco can, in some embodiments, be prepared from plants having less than 20 μg of DVT per $cm^2$ of green leaf tissue. For example, the tobacco fibers can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Fermentation typically is characterized by high initial moisture content, heat generation, and a 10 to 20% loss of dry weight. See, e.g., U.S. Pat. Nos. 4,528,993, 4,660,577, 4,848,373, 5,372,149; U.S. Publication No. 2005/0178398; and Tso (1999, Chapter 1 in Tobacco, Production, Chemistry and Technology, Davis & Nielsen, eds., Blackwell Publishing, Oxford). Cure, aged, and fermented tobacco can be further processed (e.g., cut, shredded, expanded, or blended). See, for example, U.S. Pat. Nos. 4,528,993; 4,660,577; and 4,987,907.

The tobacco fibers can be processed to a desired size. In certain embodiments, the tobacco fiber can be processed to have an average fiber size of less than 200 micrometers. In particular embodiments, the fibers are between 75 and 125 micrometers. In other embodiments, the fibers are processed to have a size of 75 micrometers or less. In some embodiments, the tobacco fibers includes long cut tobacco, which can be cut or shredded into widths of about 10 cuts/inch up to about 110 cuts/inch and lengths of about 0.1 inches up to about 1 inch. Double cut tobacco fibers can have a range of particle sizes such that about 70% of the double cut tobacco fibers falls between the mesh sizes of −20 mesh and 80 mesh.

The tobacco fibers can have a total oven volatiles content of about 10% by weight or greater, about 20% by weight or greater, about 40% by weight or greater, about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The oral tobacco product can have a different overall oven volatiles content than the oven volatiles content of the tobacco fibers used to make the oral tobacco product. The processing steps described herein can reduce or increase the oven volatiles content.

Additives

A variety of additives can be included in the oral tobacco product 110. The additives can include alkaloids (e.g., nicotine), minerals, vitamins, dietary supplements, nutraceuticals, energizing agents, soothing agents, coloring agents, amino acids, chemesthetic agent, antioxidants, food grade emulsifiers, pH modifiers, botanicals (e.g., green tea), teeth whitening (e.g., SHRIMP), therapeutic agents, sweeteners, flavorants, and combinations thereof. In certain embodiments, the additives include nicotine, sweeteners, and/or flavorants.

Nicotine

Nicotine added to the oral tobacco product can be tobacco-derived nicotine, synthetic nicotine, or a combination thereof. In certain embodiments, the oral tobacco product includes between 0.1 mg and 6.0 mg of nicotine. In some of these embodiments, the oral tobacco product includes between 1.0 mg and 3.0 mg of nicotine.

Tobacco-derived nicotine can include one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark fire cured, burley, flue cured, and cigar filler or wrapper, as well as the products from the whole leaf stemming operation. The tobacco can also be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. By processing the tobacco prior to extracting nicotine and other organoleptic components, the tobacco-derived nicotine may include ingredients that provide a favorable experience.

The tobacco-derived nicotine can be obtained by mixing cured and fermented tobacco with water or another solvent (e.g., ethanol) followed by removing the insoluble tobacco material. The tobacco extract may be further concentrated or purified. In some embodiments, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792.

The nicotine can also be purchased from commercial sources, whether tobacco-derived or synthetic. In other embodiments, the oral tobacco product can include a derivative of nicotine (e.g., a salt of nicotine).

Antioxidants

The oral tobacco product 110 can also include one or more antioxidants. Antioxidants can result in a significant reduction in the conversion of nicotine into nicotine-N-oxide when compared to oral tobacco products without antioxidants. In some cases, an oral tobacco product can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some embodiments, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the polymer (e.g., polyurethane) during an extrusion process or after the polymer is extruded (e.g., during a post-extrusion flavoring process).

The presence of antioxidant can also reduce the formation of other tobacco derived impurities, such as Cotinine and myosime.

Sweeteners

A variety of synthetic and/or natural sweeteners can be used as additives in the oral tobacco product 110. Suitable natural sweeteners include sugars, for example, monosaccharides, disaccharides, and/or polysaccharide sugars, and/or mixtures of two or more sugars. According to some embodiments, the oral tobacco product 110 includes one or more of the following: sucrose or table sugar; honey or a mixture of low molecular weight sugars not including sucrose; glucose or grape sugar or corn sugar or dextrose; molasses; com sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. The oral tobacco product 110 can also include non-nutritive sweeteners. Suitable non-nutritive sweeteners include: stevia, saccharin; Aspartame; sucralose; or acesulfame potassium.

Flavorants

The oral tobacco product 110 can optionally include one or more flavorants. The flavorants can be natural or artificial. For example, suitable flavorants include wintergreen, cherry and berry type flavorants, various liqueurs and liquors (such as Drambuie, bourbon, scotch, and whiskey) spearmint, peppermint, lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang-ylang, sage, fennel, pimenta, ginger, anise, coriander, coffee, liquorish, and mint oils from a species of the genus *Mentha*, and encapsulated flavors. Mint oils useful in particular embodiments of the oral tobacco product 110 include spearmint and peppermint. Synthetic flavorants can also be used. The particular combination of flavorants can be selected from the flavorants that are generally recognized as safe ("GRAS") in a particular country, such as the United States. Flavorants can also be included in the oral tobacco product as encapsulated flavorants.

In some embodiments, the flavorants in the oral tobacco product 110 are limited to less than 20 weight percent in sum. In some embodiments, the flavorants in the oral tobacco product 110 are limited to be less than 10 weight percent in sum. For example, certain flavorants can be included in the oral tobacco product 110 in amounts of about 1 weight percent to 5 weight percent.

Other Additives

The oral tobacco product 110 may optionally include other additives. For example, these additives can include non-nicotine alkaloids, vitamins, dietary minerals, other dietary supplements, and/or therapeutic agents. For example, suitable vitamins include vitamins A, B1, B2, B6, C, D2, D3, E, F, K, and P. For example, an oral tobacco product 110 can include C-vitamins. Suitable dietary minerals include calcium (as carbonate, citrate, etc.) or magnesium (as oxide, etc.), chromium (usually as picolinate), and iron (as bis-glycinate). One or more dietary minerals could be included in an oral tobacco product with or without the use of other additives. Other dietary supplements and/or therapeutic agents can also be included as additives.

The oral tobacco product 110 can also include fillers such as starch, di-calcium phosphate, lactose, sorbitol, mannitol, and microcrystalline cellulose, calcium carbonate, dicalcium phosphate, calcium sulfate, clays, silica, glass particles, sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, cross linked PVP), pH stabilizers, or preservatives. In some embodiments, the amount of filler in the oral tobacco product 110 is limited to less than 10 weight percent in sum. In some embodiments, the amount of filler in the oral tobacco product 110 is limited to be less than 5 weight percent in sum. In some embodiments, the fillers are mouth stable. In other embodiments, the fillers can dissolve or disintegrate during use and thus result in an oral tobacco product that becomes more pliable during use.

Fibers

The oral tobacco product can further include non-tobacco fibers within the mouth-stable polymer matrix. In some embodiments, the non-tobacco fibers are hydrophilic such that water-soluble additives can be wicked by the fiber. In some embodiments, the fibers can dissolve to leave channels. Additives can be present in the pores 135 of the mouth-stable polymer matrix 120.

The non-tobacco fibers can be non-tobacco cellulosic fibers. The non-tobacco cellulosic fibers can be derived from plant tissue. In some embodiments, the non-tobacco cellulosic fibers includes cellulose. The non-tobacco cellulosic fibers can further include lignin and/or lipids. Suitable sources for non-tobacco cellulosic fibers include wood pulp, cotton, sugar beets, bran, citrus pulp fiber, switch grass and other grasses, Salix (willow), tea, and Populus (poplar). In some embodiments, the non-tobacco cellulosic fibers can be chopped or shredded plant tissue comprising various natural flavors, sweeteners, or active ingredients. In some embodiments, the oral tobacco product 110 can include nicotine as an additive (optionally with additional sweeteners and flavors) and a combination of both non-tobacco cellulosic fiber and tobacco fiber. In some alternative embodiments, additional cellulosic fiber can be derived from tobacco plant tissue.

The oral tobacco product 110 can also include soluble fibers. The soluble fibers can be adapted to dissolve when exposed to saliva when the oral tobacco product 110 is received in an oral cavity. In some embodiments, the soluble fiber can be a maltodextrin. The maltodextrin can be derived from corn. For example, Soluble Dietary Fiber can be included in an oral tobacco product 110. Soluble fibers can be used with tobacco fibers to provide channels 135 for additives 140 and/or 142 to be released from the oral tobacco product 110. As the soluble fibers dissolve, the oral tobacco product 110 can become more flexible and the additional channels can open up to permit the release of additional tobacco constituents and/or additives 140 or 142. Suitable soluble fibers include psyllium fibers.

In some embodiments, a ratio of soluble to tobacco fiber can impact the softness of texture of the oral tobacco product 110. The ratio of soluble to tobacco fiber can also impact the compressibility of the oral tobacco product 110. In some embodiments, a ratio of soluble to tobacco fiber is between 1:60 and 60:1. In some embodiments, the ratio of soluble to tobacco fiber is greater than 1:50, greater than 1:40, greater than 1:30, greater than 1:20, greater than 1:10, or greater than 1:5. In some embodiments, the ratio of soluble to tobacco fiber is less than 1:1, less than 1:2, less than 1:5, less than 1:10, less than 1:20, or less that 1:30. In some case, an oral tobacco product having a mixture of soluble and tobacco fibers can have a percentage of compression @ 250 N of between 60 percent and 98 percent, between 65 percent and 95 percent between 70 percent and 90 percent, or between 80 and 89 percent.

Plasticizers

The oral tobacco product 110 can also include one or more plasticizers. Plasticizers can soften the final oral tobacco product and thus increase its flexibility. Plasticizers work by embedding themselves between the chains of polymers, spacing them apart (increasing the "free volume"), and thus significantly lowering the glass transition temperature for the plastic and making it softer. Suitable plasticizers include propylene glycol, glycerin, vegetable oil, and medium chain triglycerides. In some embodiments, the plasticizer can include phthalates. Esters of polycarboxylic acids with linear or branched aliphatic alcohols of moderate chain length can also be used as plasticizers. Moreover, plasticizers can facilitate the extrusion processes described below. In some embodiments, the oral tobacco product 110 can include up to 20 weight percent plasticizer. In some embodiments, the oral tobacco product 110 includes between 0.5 and 10 weight percent plasticizer, the oral tobacco product 110 can include between 1 and 8 weight percent plasticizer, or between 2 and 4 weight percent plasticizer. For example, an oral tobacco product comprising a polyurethane polymer matrix and include about 3 to 6.5 weight percent of propylene glycol.

Molding Processes

Figure 5A:
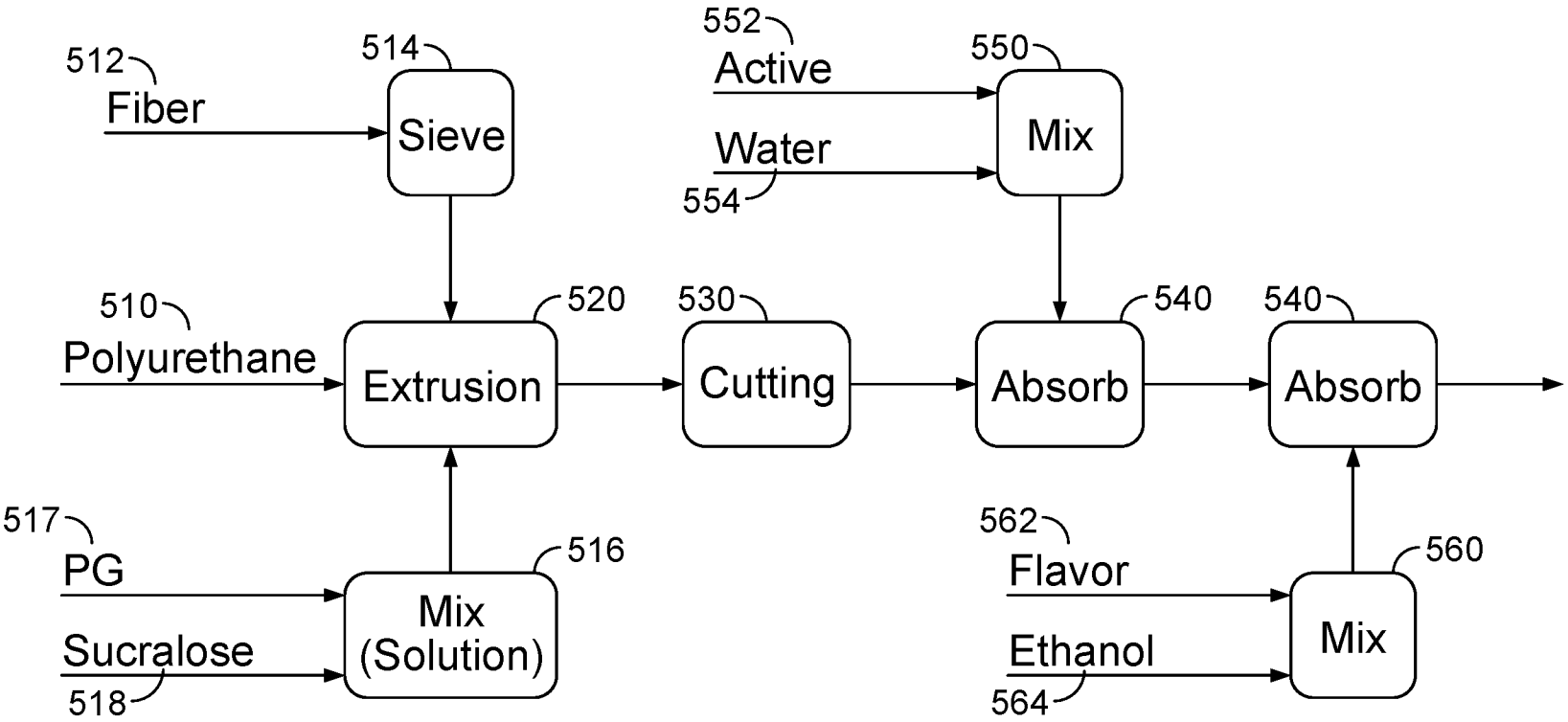
FIG. 5A illustrates a process diagram for making oral tobacco products according to some embodiments.
Figure 5B:
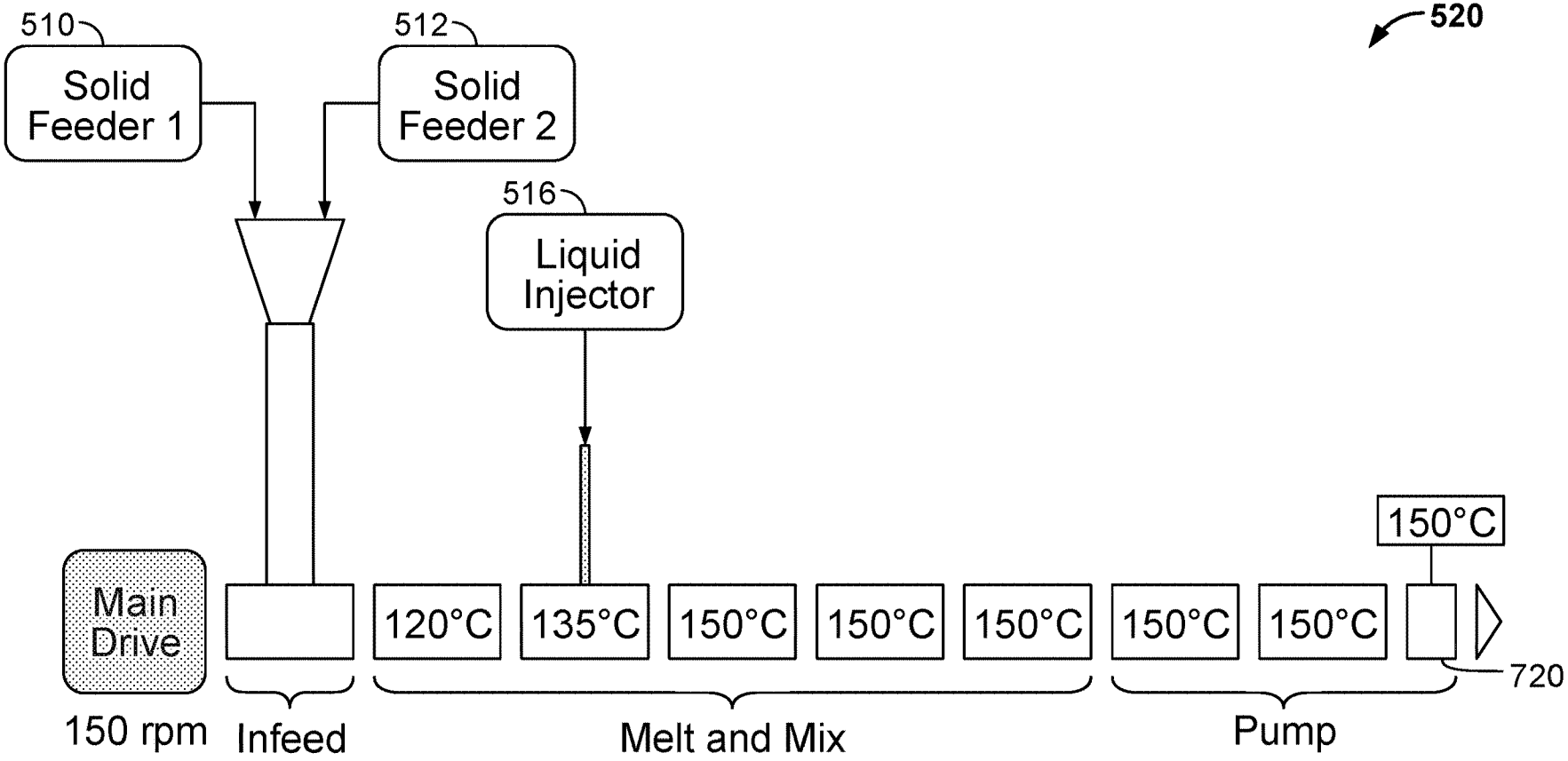
FIG. 5B illustrates an extruder configuration for making oral tobacco products according to some embodiments.

The oral tobacco product 110 can be produced by extruding a mouth-stable polymer (e.g., polyurethane) with tobacco fibers to form a rod of a mouth-stable polymer matrix including tobacco fibers. The rod is cut into individual oral tobacco products 110. FIGS. 5A and 5B depict exemplary methods to form oral tobacco products 110.

Referring to the extrusion process illustrated in FIG. 5A, a mouth-stable polymer 510 (e.g., polyurethane) is introduced into an extruder for extrusion 520 along with tobacco fibers 512. The tobacco fibers 512 can be passed through a sieve 514 prior to introduction into the extruder. A mixture of optional additives 516 can also be introduced into the extruder. The mixture of additives 516 can be a solution (as shown). As shown, the additives can include a plasticizer 517 (e.g., propylene glycol) and a sweetener 518 (e.g., sucralose). The mixture of additives can also be provided in slurry form or a dry mix of powdered additives. In other embodiments, the tobacco fibers 516 can include various additives (flavorants and/or sweeteners).

Figure 7:
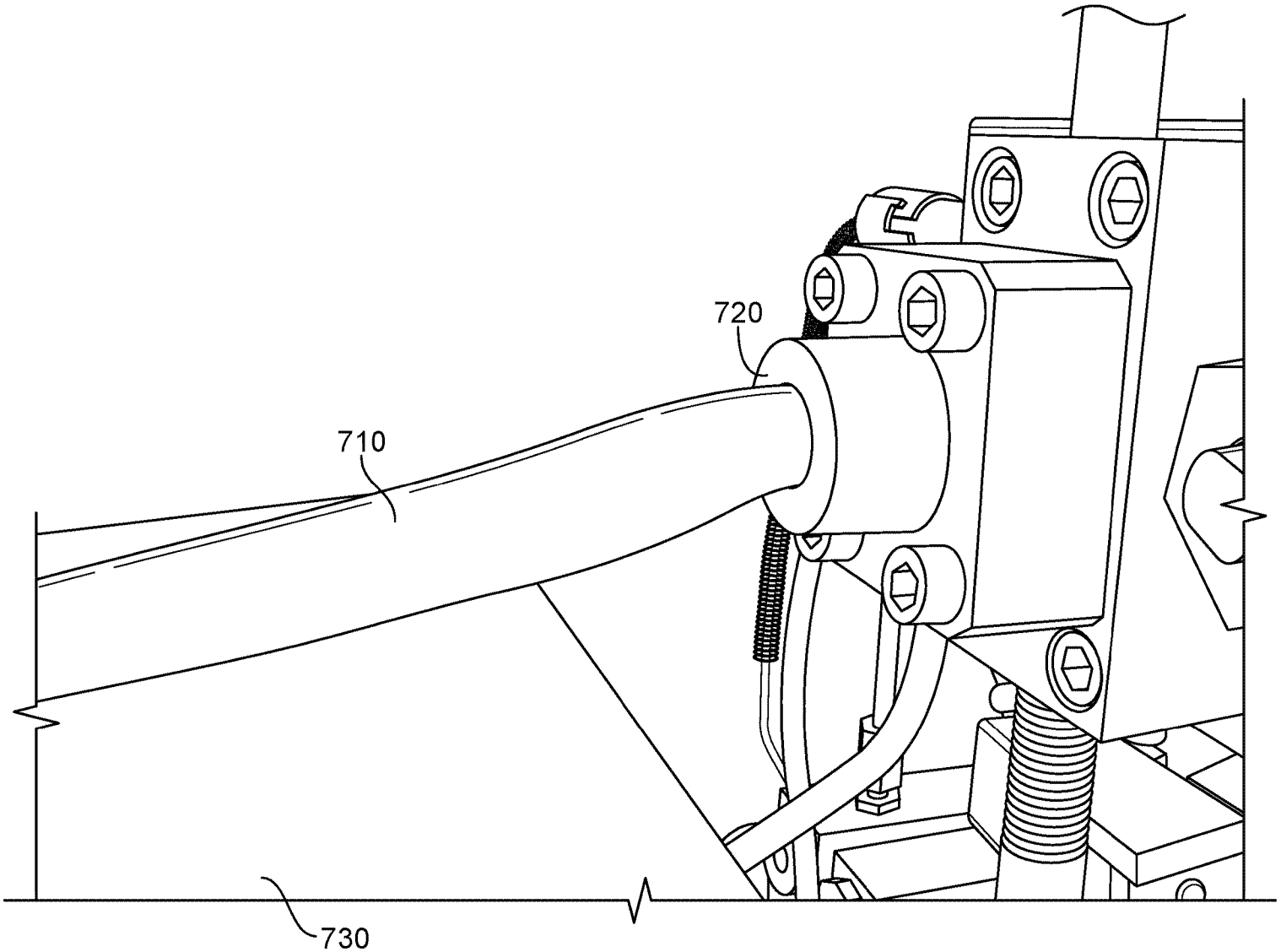
FIG. 7 illustrates a rod of mouth-stable polymer exiting an extruder die.

FIG. 5B illustrates an example of how the mouth-stable polymer 510 (e.g., polyurethane) can be compounded with tobacco fiber 512. As shown, polyurethane pellets 510 and tobacco fibers 512 can be introduced into an infeed section of an extruder. A first section of the extruder melts and mixes the polymer, elevating the temperature to about 150° C. The mixture 516 of propylene glycol 517 and sucralose 518 can be injected into the extruder downstream of the infeed section of the extruder. The polymer/tobacco fiber/plasticizer/sweetener mixture can then be extruded out of an extrusion die 720 at a temperature of about 150° C. An example of an extrusion die is shown in FIG. 7. For is example, the extruder of FIG. 5B can operate at a mass flow rate of about 1.8 lbs/hour.

The polymer-fiber combination can exit an extrusion die 720 as a rod 710 and onto a moving conveyor 730, as shown in FIG. 7. The size of the extrusion die 720, the take away speed of the moving conveyor 730, the mixture of polymer-fiber combination, and the temperature of the mixture exiting the die 720 can all have an impact on the final diameter of the rod 710.

Figure 8:
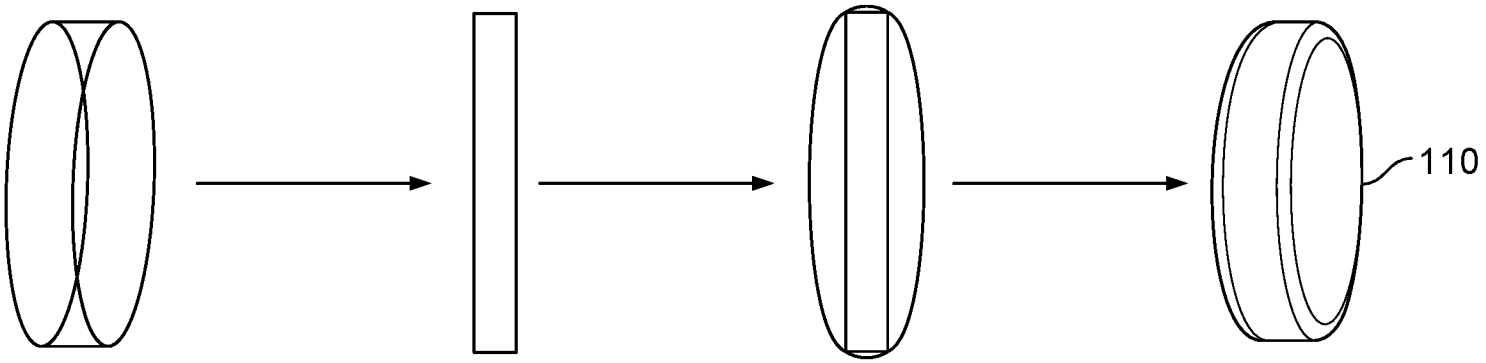
FIG. 8 illustrates how a cut piece of mouth-stable polymer including fibers and/or additives can pillow.

The extruded polymer-tobacco fiber rod 710 is then cut in a cutting process 530, as shown in FIG. 5A. The cutting can be hot-face cutting. Hot-face cutting can occur immediately after the rod 720 exits the extrusion die 720. The cutting can induce pillowing of the polymer matrix, as shown in FIG. 8. The cutting process 530 can also include a process of rounding the edges of the cut polymer-fiber composite. For example, a pelletizer can be used to round the edges. The pelletizer can also help to cool the oral tobacco products 110. In other embodiments, the extruded polymer-tobacco fiber rod 710 is cooled prior to cutting.

Before or after cutting, additional additives and/or flavorants can be added to the extruded polymer-fiber rod and/or pieces. As shown in FIG. 5A, a mixture of additives 550 and a mixture of flavorants 560 can be absorbed into polymer-tobacco fiber pieces in one or more absorbing processes 540. The mixture of additives 550 can include water 554. A mixture of flavorants 560 can include a flavor 562 (e.g., wintergreen) and a carrier 564 (e.g., ethanol). The oral tobacco products 110 could then be dried, packaged, and sealed.

Figure 6A:
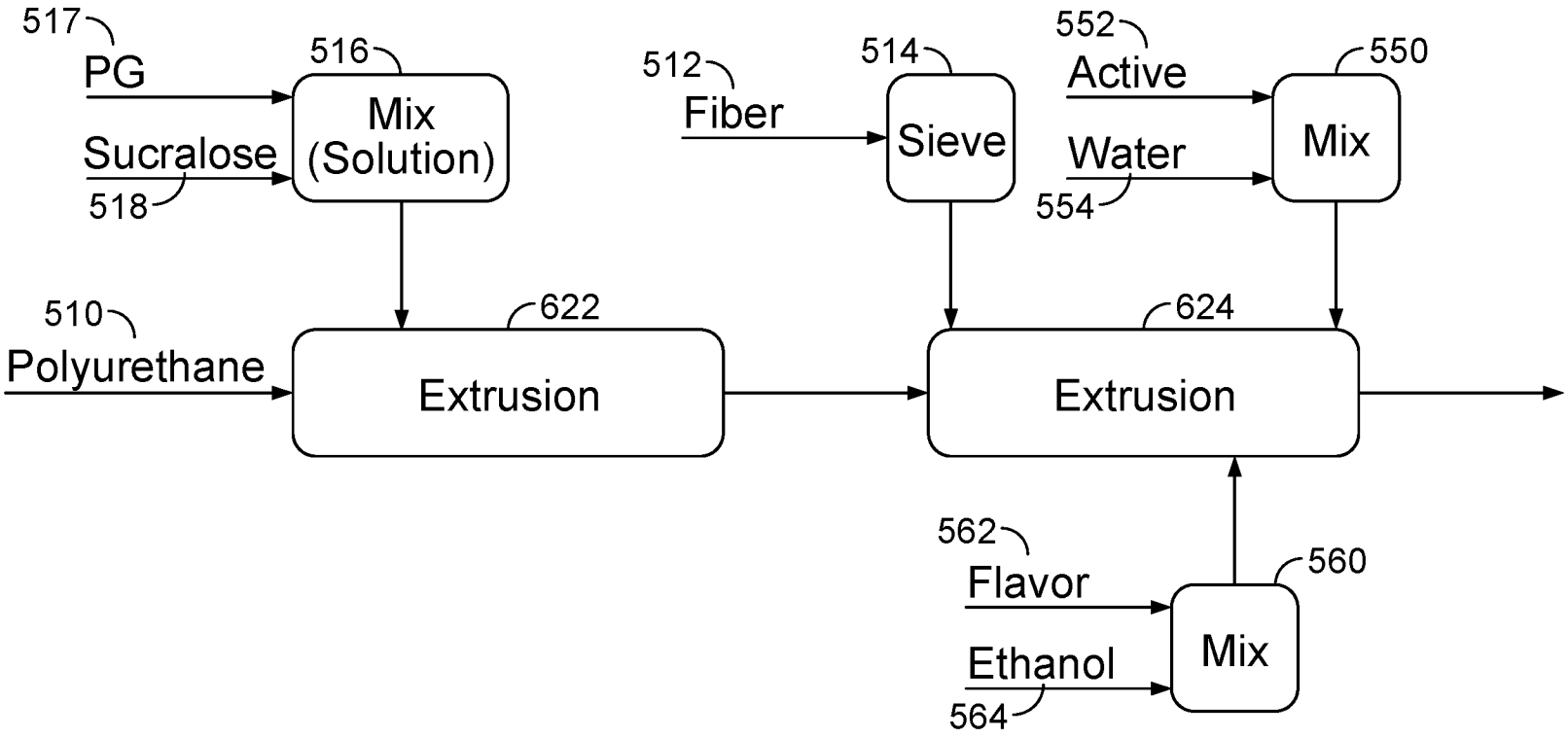
FIG. 6A illustrates a process diagram for making oral tobacco products according to other embodiments.

FIG. 6A depicts an alternative arrangement where a mouth-stable polymer 510 (e.g., polyurethane) is compounded with a mixture 516 of one or more plasticizers 517 (e.g., propylene glycol) and/or sweetners 518 (e.g., sucralose) in a first extrusion process 622. The compounded polymer/plasticizer/sweetener mixture is then compounded with tobacco fiber 512 in a second extrusion process 624. As shown, additives such as nicotine and/or flavorants 562 can also be added during the second extrusion process 624. In some embodiments, the compounding in the first extrusion process occurs at a higher temperature than the compounding during the second extrusion process. Both extrusion processes can occur in a single extruder.

Figure 6B:
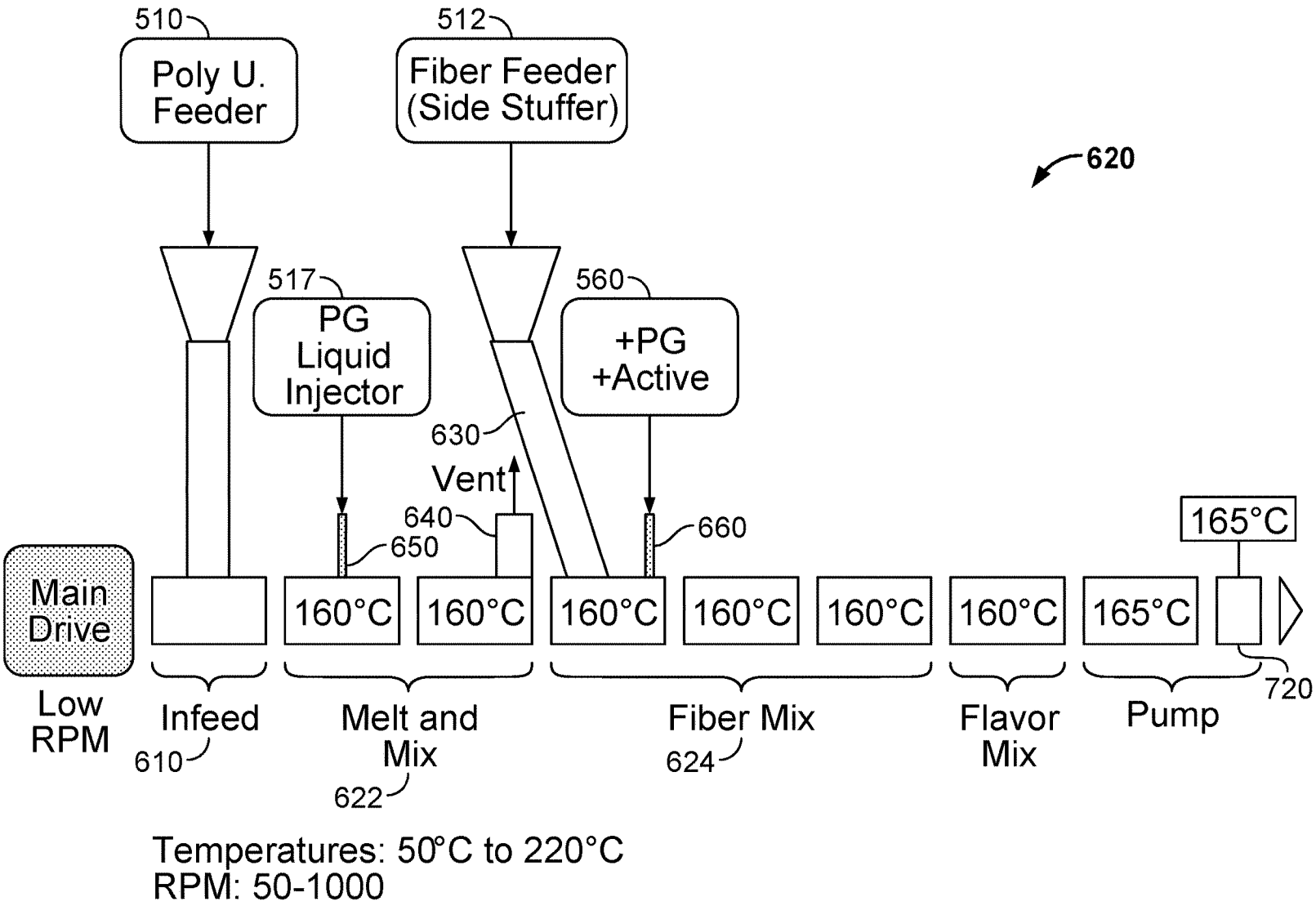
FIG. 6B illustrates an extruder configuration for making oral tobacco products according to certain embodiments

FIG. 6B depicts an arrangement of an extruder where the active, plasticizer, tobacco fibers and flavorants are all added the mouth-stable polymer in the extruder. Polyurethane pellets 510 are added to an infeed section 610 of the extruder 620. Plasticizer 517 (e.g., propylene glycol) (and optionally actives, sweeteners, and/or carriers) are injected into a first section of the extruder and compounded with the polyurethane. A vent 640 can be provided to release volatiles. Tobacco fibers 512 can be introduced into the extruder through a side feeder 630. A flavorant mixture 560 can be added through liquid injector 660 in a flavor mixing section of the extruder. Active 52 (e.g., nicotine) and plasticizer 517 can also be injected through liquid injector 660. The mixture can then be extruded through an extrusion die 720 at a temperature of about 165° C. The extruded mixture can be hot-cut as it exits the extrusion die 720 and passed to a pelletizer. In other embodiments, the extruded mixture can be cooled on a cooling conveyer and cut. For example, the extruder of FIG. 6B can operate at a mass flow rate of about 5.5 lbs/hour. After cutting, the oral tobacco products 110 can be further flavored in a pan coater. The oral tobacco products 110 can then be sent to bulk storage and packaged.

In addition to the methods described above, there are many methods for making and shaping the oral tobacco products. In some embodiments, extruded and cut pieces can be introduced into a compression mold to form a final oral tobacco product shape. In other embodiments, the oral tobacco products 110 can be injection molded, compression molded, or injection-compression molded. Blocks of polymer and tobacco fiber (and optionally other additives) can also be formed and machined into a desired shape.

OTHER EMBODIMENTS

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. An oral tobacco product, comprising:

a body that is wholly receivable in an oral cavity, the body including, a fiber-polymer matrix including, a mouth-stable polymer matrix including polyurethane in an amount greater than or equal to about 60 weight percent; and tobacco fibers in an amount greater than or equal to about 10 weight percent, the tobacco fibers being embedded in the mouth-stable polymer matrix; and an additive absorbed in the fiber-polymer matrix, the additive configured to be released from the body when the body is received within the oral cavity and exposed to saliva, and the tobacco fibers forming channels extending from one surface of the oral tobacco product to an opposite surface of the oral tobacco product in the fiber-polymer matrix.

2. The oral tobacco product of claim 1, further comprising:

a plasticizer dispersed in the fiber-polymer matrix.

3. The oral tobacco product of claim 2, wherein the plasticizer includes propylene glycol, glycerin, vegetable oil, triglycerides, or any combination thereof.

4. The oral tobacco product of claim 1, further comprising:

a sweetener dispersed in the body.

5. The oral tobacco product of claim 4, wherein the sweetener includes saccharine, sucralose, aspartame, acesulfame potassium, or any combination thereof.

6. The oral tobacco product of claim 1, wherein the additive includes nicotine, a nicotine derivative, or a combination of the nicotine and the nicotine derivative.

7. The oral tobacco product of claim 1, further comprising:

a supplemental additive including minerals, vitamins, dietary supplements, nutraceuticals, energizing agents, soothing agents, amino acids, chemesthetic agents, antioxidants, botanicals, teeth whitening agents, therapeutic agents, or any combination thereof, wherein the supplemental additive is dispersed in the body or the tobacco fibers such that the supplemental additive is released when the body is held within a mouth of an adult tobacco consumer.

8. The oral tobacco product of claim 1, further comprising:

a flavorant dispersed in the body, such that the flavorant is released when the body is held within a mouth of an adult tobacco consumer.

9. The oral tobacco product of claim 8, wherein the flavorant includes licorice, wintergreen, cherry and berry type flavorants, Drambuie, bourbon, scotch, whiskey, spearmint, peppermint, lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, pimenta, ginger, anise, coriander, coffee, mint oils from a species of the genus *Mentha*, or any combination thereof.

10. The oral tobacco product of claim 1, further comprising:

an antioxidant.

11. The oral tobacco product of claim 10, wherein the oral tobacco product includes the antioxidant in an amount ranging from about 0.01 weight percent to about 5.0 weight percent.

12. The oral tobacco product of claim 10, wherein the antioxidant includes ascorbyl palmitate, BHT, ascorbic acid, sodium ascorbate, monosterol citrate, tocopherols, propyl gallate, tertiary butylhydroquinone (TBHQ), butylated hydroxyanisole (BHA), Vitamin E, or any combination thereof.

13. The oral tobacco product of claim 1, further comprising:

a soluble fiber.

14. The oral tobacco product of claim 13, wherein the soluble fiber includes maltodextrin.

15. The oral tobacco product of claim 1, wherein the body has a compressibility @ 250 N ranging from about 45% to about 95%.

16. The oral tobacco product of claim 1, wherein the body has a compressibility @ 425 N ranging from about 60% to about 99%.

17. The oral tobacco product of claim 1, wherein the body has a percentage of springiness of greater than or equal to about 20%.

18. The oral tobacco product of claim 1, wherein the body is shield shaped.

19. The oral tobacco product of claim 1, wherein the body has a diameter ranging from about 5 to about 25 millimeters and a thickness ranging from about 1 to about 10 millimeters.

20. The oral tobacco product of claim 1, further comprising:

non-tobacco cellulosic fibers.

21. The oral tobacco product of claim 1, further comprising:

a flavorant dispersed in the tobacco fibers such that the flavorant is released when the body is held within a mouth of an adult tobacco consumer.

* * * * *